US008826705B2

(12) United States Patent
Tien

(10) Patent No.: US 8,826,705 B2
(45) Date of Patent: Sep. 9, 2014

(54) OUTER OPERATIONAL DEVICE FOR A DOOR LOCK

(71) Applicant: Hung-Jen Tien, Tainan (TW)

(72) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 125 days.

(21) Appl. No.: 13/719,298

(22) Filed: Dec. 19, 2012

(65) Prior Publication Data

US 2014/0165669 A1 Jun. 19, 2014

(51) Int. Cl.

| | |
|---|---|
| ***E05B 65/10*** | (2006.01) |
| ***E05B 3/00*** | (2006.01) |
| ***E05B 55/00*** | (2006.01) |

(52) U.S. Cl.

CPC ..... *E05B 55/005* (2013.01)
USPC .... 70/92; 70/107; 70/210; 70/224; 292/336.3

(58) Field of Classification Search

CPC ..... E05B 13/002; E05B 13/004; E05B 55/00; E05B 55/005; E05B 55/12; E05B 59/00; E05B 63/22; E05B 65/10; E05B 65/1086; E05B 65/1093
USPC ..... 70/92, 107–111, 141, 210, 211, 224; 292/21, 92, 336.3
See application file for complete search history.

(56) References Cited

U.S. PATENT DOCUMENTS

| | | | | |
|---|---|---|---|---|
| 5,655,393 | A * | 8/1997 | Kuo et al. | 70/92 |
| 5,658,026 | A * | 8/1997 | Nigro et al. | 292/336.3 |
| 6,170,305 | B1 * | 1/2001 | Shen | 70/107 |
| 7,181,940 | B2 * | 2/2007 | Lin | 70/92 |
| 7,363,784 | B2 * | 4/2008 | Shvarts | 70/107 |
| 7,634,927 | B1 * | 12/2009 | Tien | 70/92 |
| 8,011,702 | B2 | 9/2011 | Tien et al. | 292/336.3 |
| 8,267,442 | B2 | 9/2012 | Tien et al. | 292/93 |
| 8,590,948 | B2 * | 11/2013 | Shen | 292/336.3 |
| 2006/0010942 | A1 * | 1/2006 | Toloday et al. | 70/210 |
| 2014/0102155 | A1 * | 4/2014 | Lin | 70/92 |

* cited by examiner

*Primary Examiner* — Christopher Boswell
(74) *Attorney, Agent, or Firm* — Alan Kamrath; Kamrath IP Lawfirm, P.A.

(57) ABSTRACT

An outer operational device (13) for a door lock includes cover (20) receiving a sliding block (511) and a handle (197) operatively connected to the sliding block (511). The sliding block (511) includes a sliding groove (525) having a horizontal section (528) slideably receiving a locking member (541). A driving member (44) is fixed to a connection member (595) in the cover (20) and is operatively connected to a latch (124). When the locking member (541) is in a first position, pivotal movement of the handle (197) drives the sliding block (511) to actuate the connection member (595) and the driving member (44) to retract the latch (124). When the locking member (541) is in the second position, the sliding block (511) is moved without actuating the connection member (595) when handle (197) is pivoted, and the latch (124) remains in the latching position.

6 Claims, 19 Drawing Sheets

OUTER OPERATIONAL DEVICE FOR A DOOR LOCK

BACKGROUND OF THE INVENTION

The present invention relates to an outer operational device for a door lock and, more particularly, to an outer operational device mounted to an outer side of a door for retracting a latch of a latch device mounted to the door.

Various door locks have been developed according to differing needs in different places. One type of the door lock includes a latch device mounted between inner and outer sides and having a latch. An outer operational device is mounted to the outer side of the door and operatively connected to the latch device. The outer operational device can be locked for burglarproof functions or curfew, and a key is required to unlock the outer operational device for subsequent unlatching by operating a handle of the outer operational device. Components connected to the handle are generally fixed together with the handle in the locking state. The handle is generally in the form of a lever that is in a horizontal position in the locking state to allow easy, force-saving operation. However, the components connected to the handle may deform or even be damaged due to improper operation, such as applying an excessive force to the handle in the locking state.

Thus, a need exists for an outer operational device for a door lock that provides protection of the components connected to the handle.

BRIEF SUMMARY OF THE INVENTION

The present invention solves this need and other problems in the field of door locks by providing an outer operational device including a cover having a space delimited by a sidewall. A first guide pin and a second guide pin are formed on the sidewall. The sidewall includes a receiving portion having an opening. The sidewall further including an engaging hole, the first and second guide pins located between the receiving portion and the engaging hole. The cover is adapted to be mounted to an outer side of a door. A spindle is pivotably received in the engaging hole of the cover. The spindle includes a coupling end received in the space of the cover. A handle is located outside of the cover and fixed to the spindle, with the handle and the spindle jointly pivotable. An actuating member is received in the space and mounted to the spindle, with the actuating member and the spindle jointly pivotable. A limiting plate is received in the space and engaged with the second guide pin. The limiting plate includes a wing.

A sliding block is received in the space and slideable along a first axis. The sliding block includes first and second faces. First and second sliding grooves extend from the first face through the second face of the sliding block. The first sliding groove includes a vertical section extending along the first axis and a horizontal section extending along a second axis perpendicular to the first axis. The sliding block further includes a leg having an upper face and a lower face spaced from the upper face along the first axis. The first guide pin of the cover slideably extends through the vertical section of the first sliding groove of the sliding block. The second guide pin slideably extends through the second sliding groove of the sliding block. The limiting plate is located between the second face of the sliding block and the sidewall of the cover along a third axis perpendicular to the first and second axes. The wing of the limiting plate is aligned with the leg of the sliding block. The lower face of the leg abuts a first end of the actuating member. The lower face of the leg is pressed against by the first end of the actuating member when the actuating member pivots, causing movement of the sliding block from a lower position to an upper position along the first axis. A spring has two ends respectively abutting against the wing of the limiting plate and the leg, with the spring biasing the sliding block from the upper position to the lower position.

A locking member is slideably received in the horizontal section of the first sliding groove of the sliding block. The locking member includes a block having first and second ends spaced from each other along the second axis. The block further includes upper and lower faces extending between the first and second ends of the block. A passage extends from the upper face through the lower face of the block. The block has a side located outside of the horizontal section of the first sliding groove of the sliding block. The locking member is movable between first and second positions along the second axis.

A push member is pivotably connected to the second guide pin of the cover. The push member includes first and second sides spaced from each other along the third axis. An opening extends from the first side through the second side of the push member and includes first and second push faces spaced from each other along the second axis. A push groove is defined in the first side of the push member and includes first and second sidewalls facing each other. The first sidewall is located between the second sidewall and the first push face. The second sidewall is located between the first sidewall and the second push face. The side of the block of the locking member is received in the opening of the push member. The first end of the locking member abuts the first push face of the push member. The second end of the locking member abuts the second push face of the push member. The sliding block is located between the second side of the push member and the limiting plate along the third axis. The locking member moves between the first and second positions when the push member pivots.

A cylinder is mounted in the opening of the cover and includes an actuator, with the actuator adapted to pivot through operation by a key. A mover is pivotably mounted around the cylinder and includes an actuating bar received in the push groove of the push member. The mover further includes a tab operably connected to the actuator. The push member pivots when the actuator pivots. A connection member is slideably received in the space and includes upper and lower ends spaced from each other along the first axis. The connection member further includes first and second surfaces extending between the upper and lower ends of the connection member. The connection member is movable between a push position and a releasing position along the first axis. A follower rod includes an end fixed to the connection member. The follower rod is located above the upper face of the locking member when the sliding block is in the lower position. A driving member is fixed to the first surface of the connection member. The driving member includes a pressing rod adapted to be operatively connected to a latch of a latch device mounted to the door.

When the actuating bar of the mover presses against the first sidewall of the push member while the locking member is in the first position, the second push face of the push member presses against the second end of the locking member, moving the locking member from the first position to the second position, and a position of the passage of the locking member along the second axis is aligned with a position of the follower rod along the second axis.

When the actuating bar of the mover presses against the second sidewall of the push member while the locking member is in the second position, the first push face of the push member presses against the first end of the locking member, moving the locking member from the second position to the first position, and the position of the passage of the locking member along the second axis is not aligned with the position of the follower rod along the second axis.

With the locking member in the first position, when the handle is pivoted to move the sliding block from the lower position to the upper position and compresses the spring, the locking member presses against the follower rod to move the connection member from the releasing position to the push position, the pressing rod is adapted to move the latch from a latching position outside of the door to an unlatching position received in the door.

With the locking member in the second position, when the handle is pivoted to move the sliding block from the lower position to the upper position and compresses the spring, the passage of the locking member movably receives the follower rod, the connection member remains in the releasing position without moving the pressing rod, the latch is adapted to remain in the latching position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
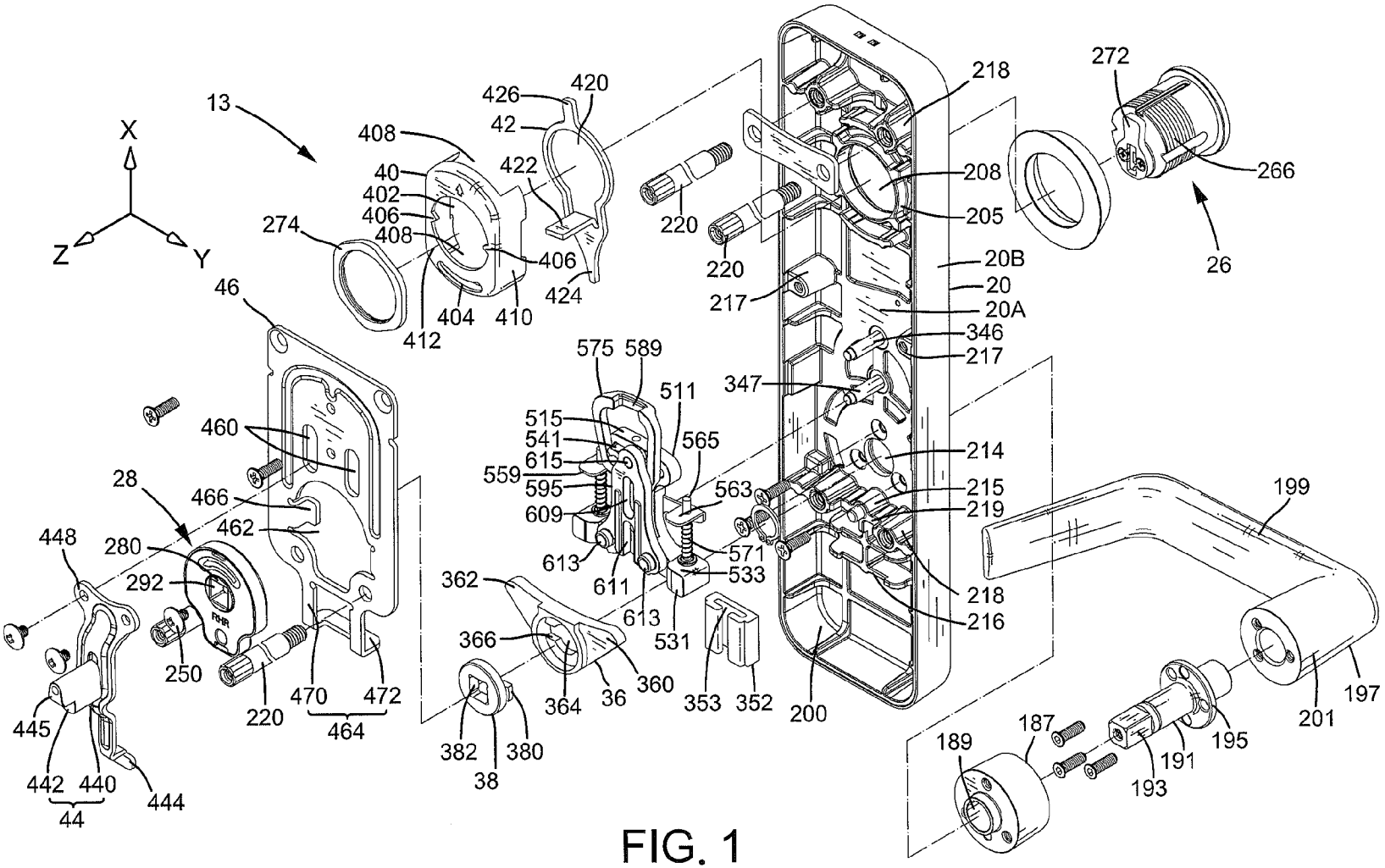
FIG. 1 shows an exploded, perspective view of an outer operational device according to the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "inner", "outer", "side", "end", "portion", "section", "axial", "lateral", "horizontal", "vertical", "annular", "inward", "spacing", "counterclockwise", "length", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An outer operational device 13 according to the present invention includes a cover 20 having a sidewall 20A and an annular wall 20B extending perpendicularly along a periphery of sidewall 20A, defining a space 200 between annular wall 20B and sidewall 20A. First and second guide pins 346 and 347 are formed on sidewall 20A and located in space 200. Cover 20 further includes a receiving portion 205 on an upper portion of an inner face of sidewall 20A, with receiving portion 205 having an opening 208. A protrusion 215 is formed on the inner face of sidewall 20A and located below receiving portion 205. Protrusion 215 includes a first groove 216 and a second groove 219. Sidewall 20A includes an engaging hole 214 intermediate protrusion 215 and receiving portion 205 along a first axis X. First and second guide pins 346 and 347 are located between receiving portion 205 and engaging hole 214 along first axis X. Cover 20 further includes a plurality of engagement portions 218 on sidewall 20A. Two supports 217 are formed on the inner face of sidewall 20A and located in space 200 and between receiving portion 205 and engaging hole 214. A guiding block 352 is provided in first groove 216 and has a sliding groove 353.

Outer operational device 13 further includes a spindle 191 and a sleeve 187. Sleeve 187 is fixed to an outer face of sidewall 20A of cover 20 and includes a pivotal hole 189 aligned with engaging hole 214. Spindle 191 includes a flange 195 and a coupling end 193. Spindle 191 is pivotably received in pivotal hole 189 of sleeve 187, with flange 195 abutting an end face of sleeve 187, with coupling end 193 extending through pivotal hole 189 into space 200 of cover 20.

Outer operational device 13 further includes a handle 197 fixed to an end of spindle 191 located outside of cover 20. Handle 197 includes a lever 199 and an engagement portion 201 fixed to flange 195, allowing joint rotation of handle 197 and spindle 191.

Outer operational device 13 further includes an actuating member 36 having a connecting hole 364 in an intermediate portion thereof. Two diametrically opposed rectangular grooves 366 are formed in an inner periphery of connecting hole 364. Actuating member 36 further includes first and second ends 360 and 362 on opposite sides of connecting hole 364. Actuating member 36 is received in space 200. Spindle 191 is pivotably received in connection hole 364.

Outer operational device 13 further includes a follower 38 in the form shown as a ring. Follower 38 includes a non-circular hole 382. Follower 38 further includes two diametrically opposed teeth 380. Coupling end 193 of spindle 191 is received in non-circular hole 382 of follower 38, with teeth 380 engaged in grooves 366. Thus, spindle 191 and follower 38 rotate jointly due to non-circular hole 382 and non-circular coupling end 193. Furthermore, since teeth 380 of follower 38 engaged in grooves 366 of actuating member 36, rotation of spindle 191 also causes rotation of actuating member 36.

Outer operational device 13 further includes a limiting plate 559 having an engagement portion 561 and two wings 563 extending from engagement portion 561. Engagement portion 561 of limiting plate 559 engages with second guide pin 347 and is located in space 200 of cover 20.

Figure 2:
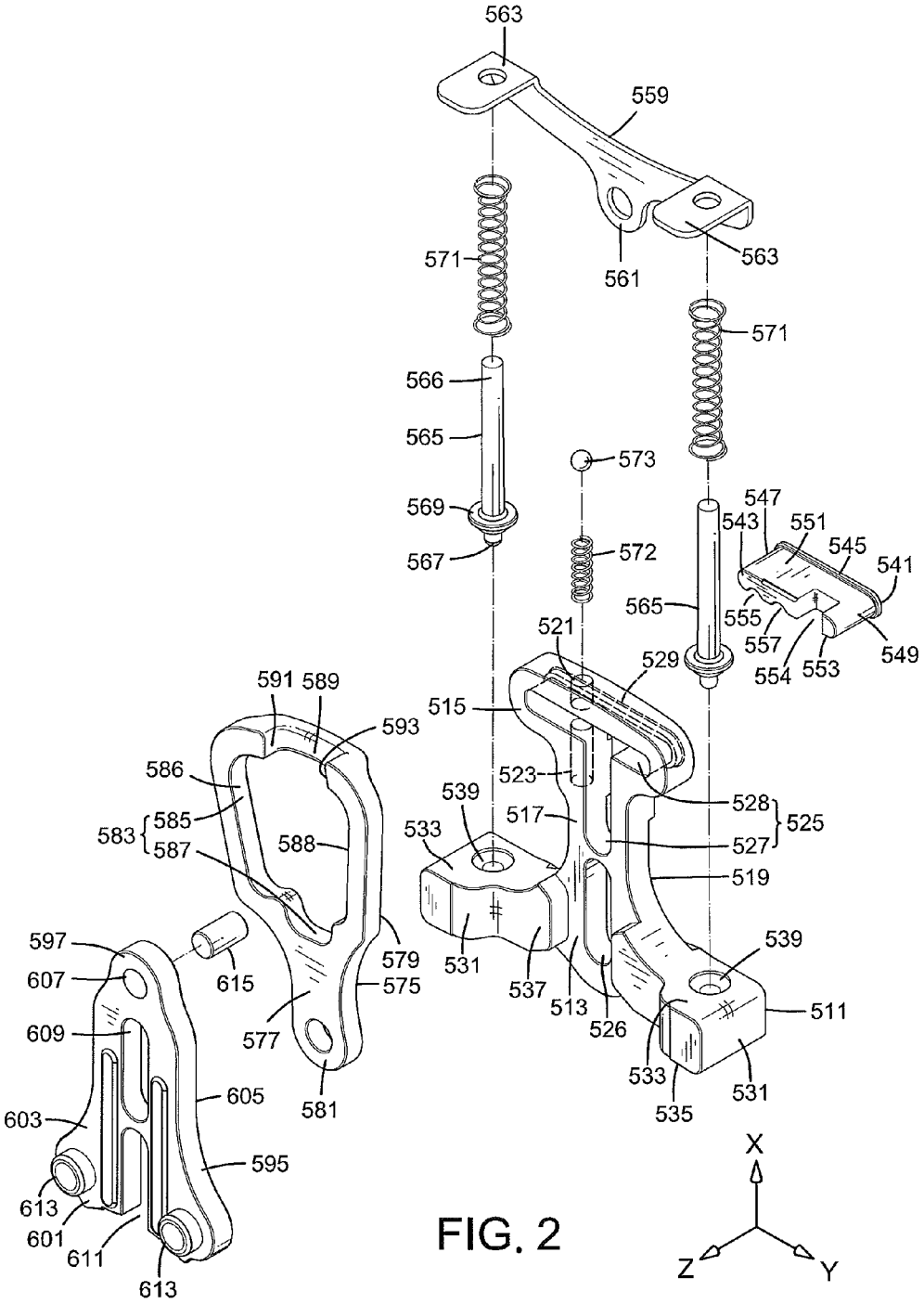
FIG. 2 shows some components of the outer operational device.
Figure 2A:
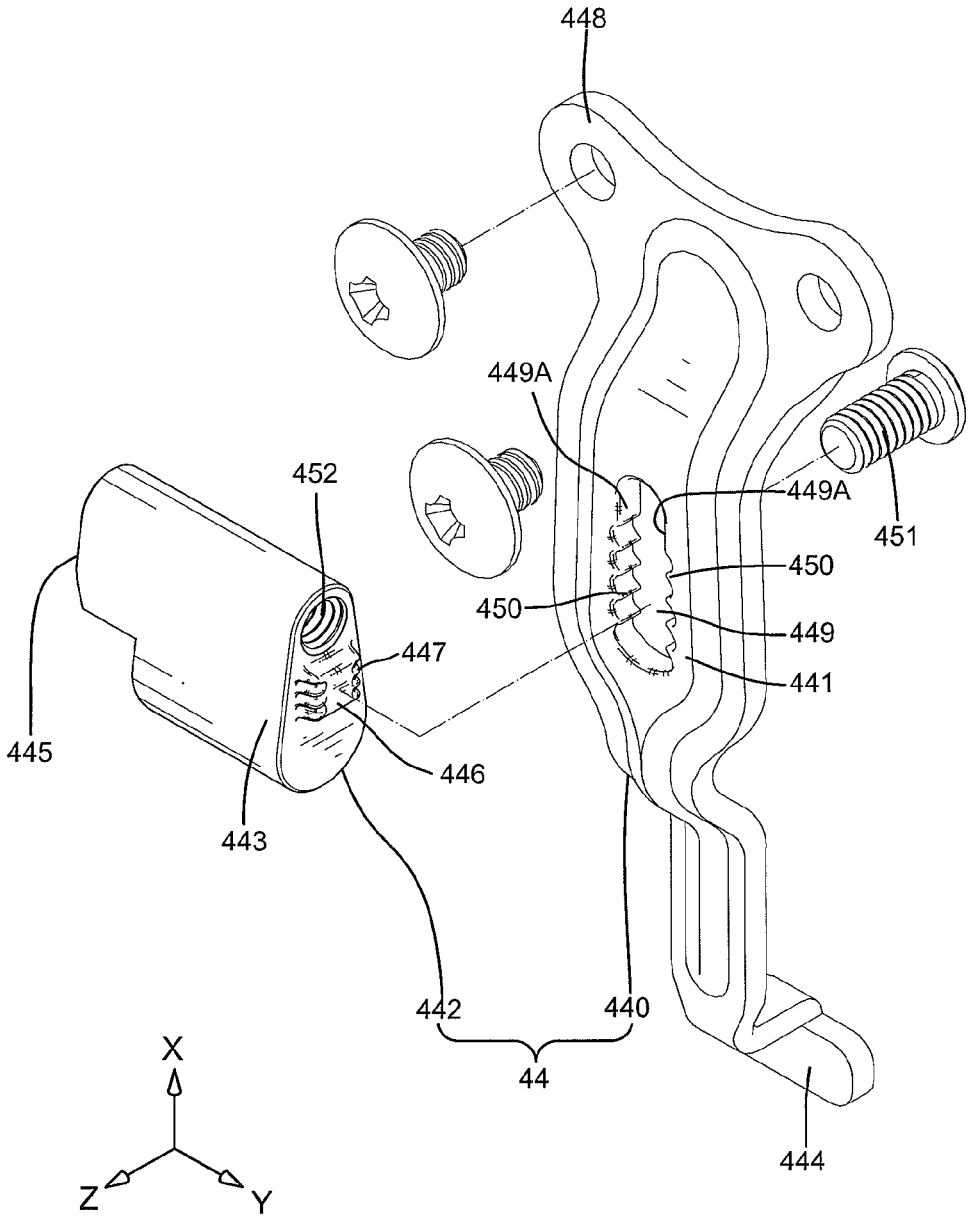
FIG. 2A shows an exploded, perspective view of a driving member of the outer operational device.
Figure 3:
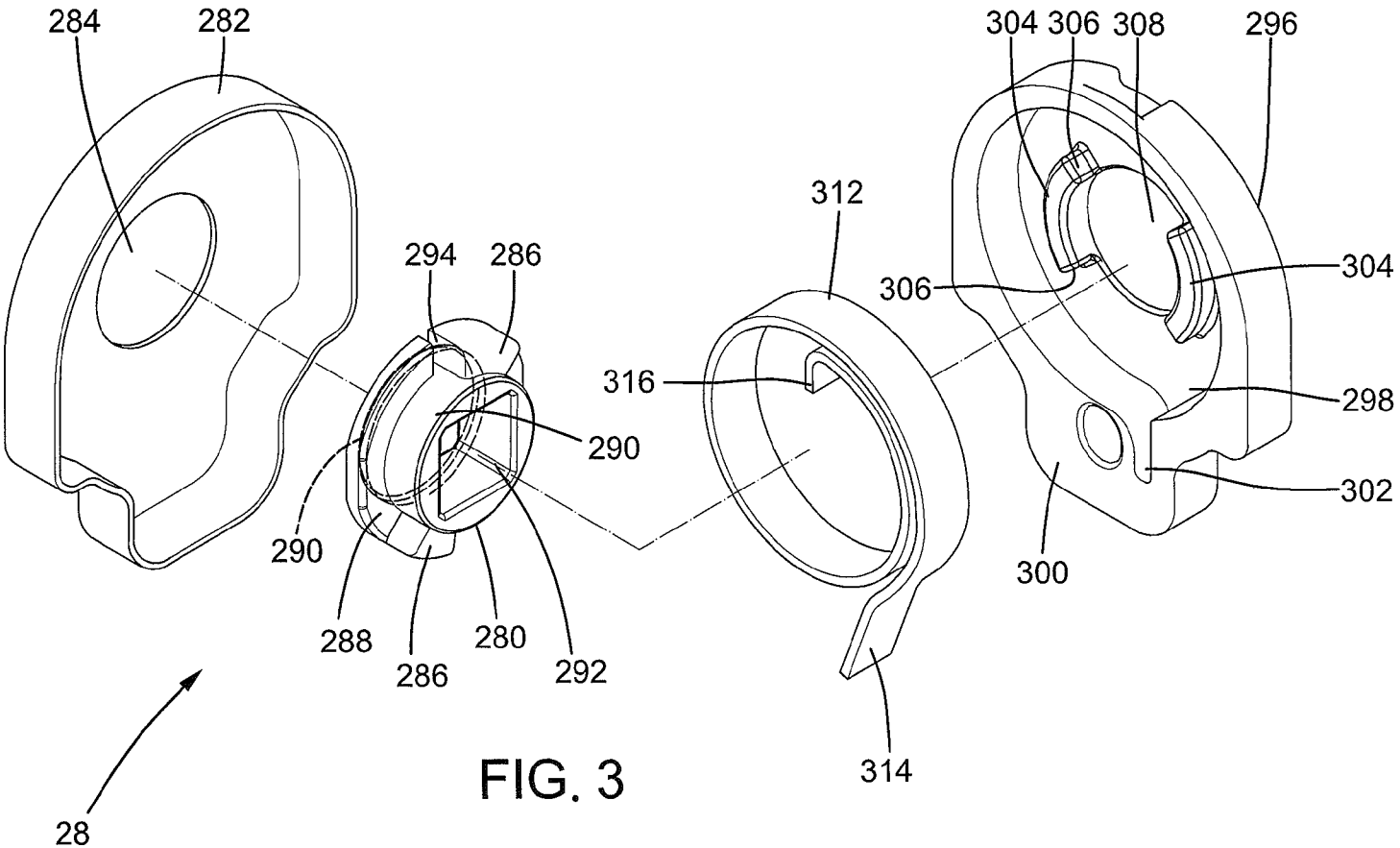
FIG. 3 shows an exploded, perspective view of a returning device of the outer operational device.
Figure 4:
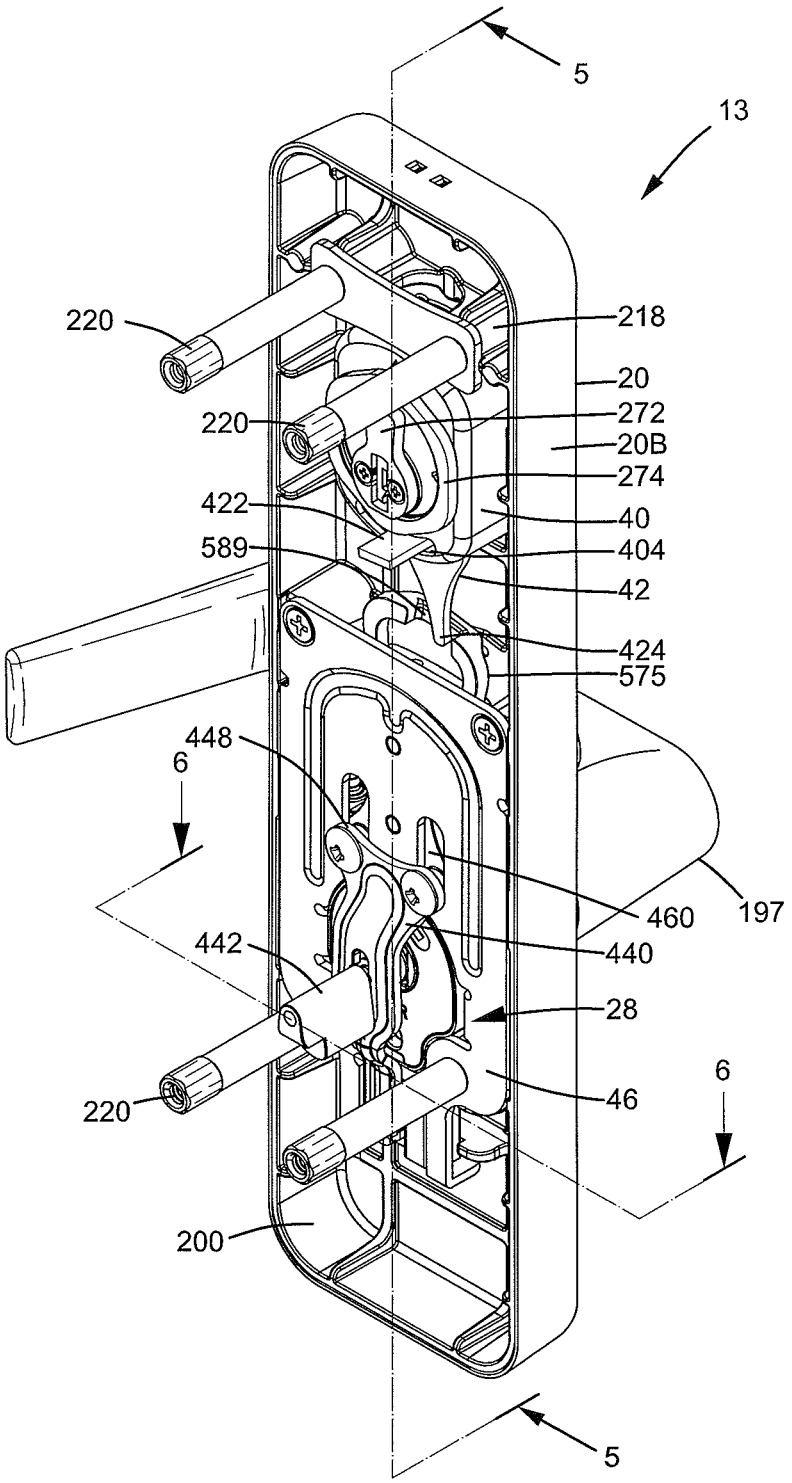
FIG. 4 shows a perspective view of the outer operational device.

Outer operational device 13 further includes a sliding block 511 slideably received in space 200 of cover 20 along first axis X. Sliding block 511 is substantially T-shaped and includes a body 513 having first and second faces 517 and 519. Body 513 further includes first and second sliding grooves 525 and 526, with first sliding groove 525 being T-shaped and extending from first face 517 through second face 519, with second sliding groove 526 located below first sliding groove 525 and extending from first face 517 through second face 519. First sliding groove 525 includes a vertical section 527 extending along first axis X and a horizontal section 528 perpendicular to vertical section 527. Horizontal section 528 is located in an upper portion 515 of body 513. An annular recess 529 is defined in second face 519 and surrounds horizontal section 528. A through-hole 512 extends from a top face of body 513 of sliding block 511 to the horizontal section 528. A receptacle 523 is defined in a wall of horizontal section 528 and aligned with through-hole 521 along first axis X (FIG. 2). Sliding block 511 further includes two legs 531 on opposite side of body 513, with second sliding groove 526 located between legs 531 along a second axis Y perpendicular to first axis X. Each leg 531 includes an upper face 533 and a lower face 535 spaced from upper face 533 along first axis X. A positioning hole 539 is defined in upper face 533 of each leg 531. Each leg 531 further includes a lateral face 537 extending between upper and lower faces 533 and 535.

First guide pin 346 of cover 20 slideably extends through vertical section 527 of first sliding groove 525 of sliding block 511. Second guide pin 347 of cover 20 slideably extends through vertical section 527 of sliding block 511. Limiting plate 559 is located between second face 519 of sliding block 511 and sidewall 20A of cover 20 along a third axis Z perpendicular to first and second axes X and Y. Sliding block 511 is movable between an upper position (FIG. 13) and a lower position (FIG. 7) in a length of vertical section 527 of first sliding groove 525 and a length of second sliding groove 526 along first axis X. When sliding block 511 is in the lower position, lower face 535 of each leg 531 is aligned with first and second ends 360 and 362 of actuating member 36.

A spring 572 and a positioning member 573 extend through through-hole 521 into receptacle 523. Spring 572 biasing positioning member 573 such that a portion of positioning member 573 is located in horizontal section 528 of first sliding groove 525.

Outer operational device 13 further includes two guiding rods 565 mounted between limiting plate 559 and sliding block 511. Each guiding rod 565 includes an engagement end 566 slideably engaged with one of wings 563 of limiting plate 559 and a positioning end 567 engaged with positioning hole 539 of one of legs 531 of sliding block 511. A flange 569 is formed on each guiding rod 565 and located on positioning end 567. Each guiding rod 565 moves together with sliding block 511 between the upper and lower positions. Each wing 563 of limiting plate 559 provides support for smooth sliding movement of one of guiding rods 565. A spring 571 is mounted around each guiding rod 565. Each spring 571 includes an upper end abutting one of wings 563 of limiting plate 559 and a lower end abutting flange 569 of one of guiding rods 565. Springs 571 bias sliding block 511 to the lower position. Thus, springs 571 are compressed for returning purposes when sliding block 511 moves from the lower position to the upper position, and guiding rods 565 avoids distortion of compressed springs 571.

Outer operational device 13 further includes a locking member 541 slideably received in horizontal section 528 of first sliding groove 525 of sliding block 511. Locking member 541 includes a block 543 and a flange 545 formed along a periphery of a side of block 543. Specifically, block 543 includes an upper face 551 and a lower face 553 spaced from upper face 551 along first axis X. Block 543 further includes first and second ends 547 and 549 extending between upper and lower faces 551 and 553. The side of block 543 with flange 545 extends between first and second ends 547 and 549 and extends between upper and lower faces 551 and 553 of block 543. A passage 554 extends from upper face 551 through lower face 553 of block 543 and is spaced from flange 545 along third axis Z. Block 543 further includes first and second grooves 555 and 557 defined in lower face 553, with second groove 557 located between first groove 555 and passage 554 along second axis Y.

Figure 5:
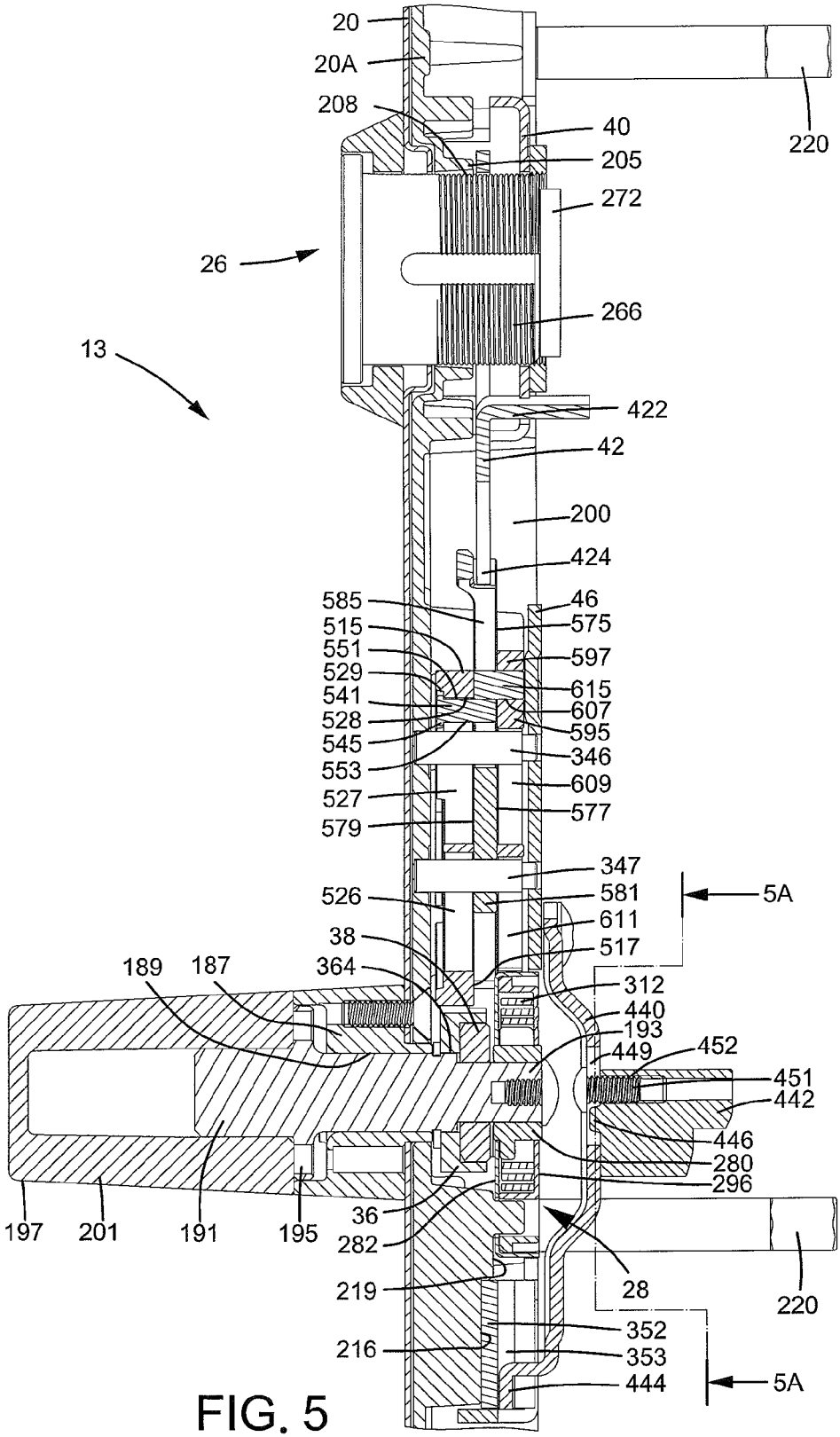
FIG. 5 shows a cross sectional view taken along section line 5-5 of FIG. 4.
Figure 5A:
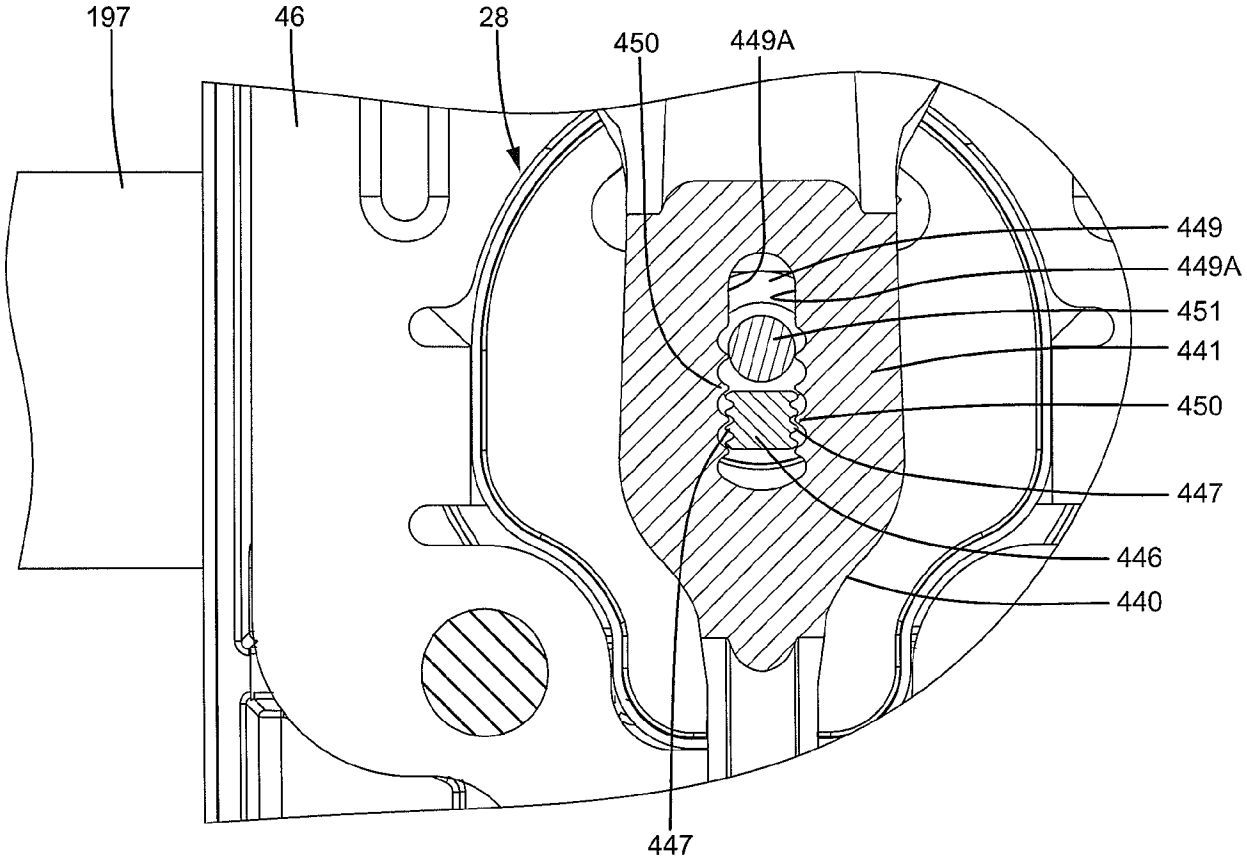
FIG. 5A shows a cross sectional view taken along section line 5A-5A of FIG. 5.
Figure 6:
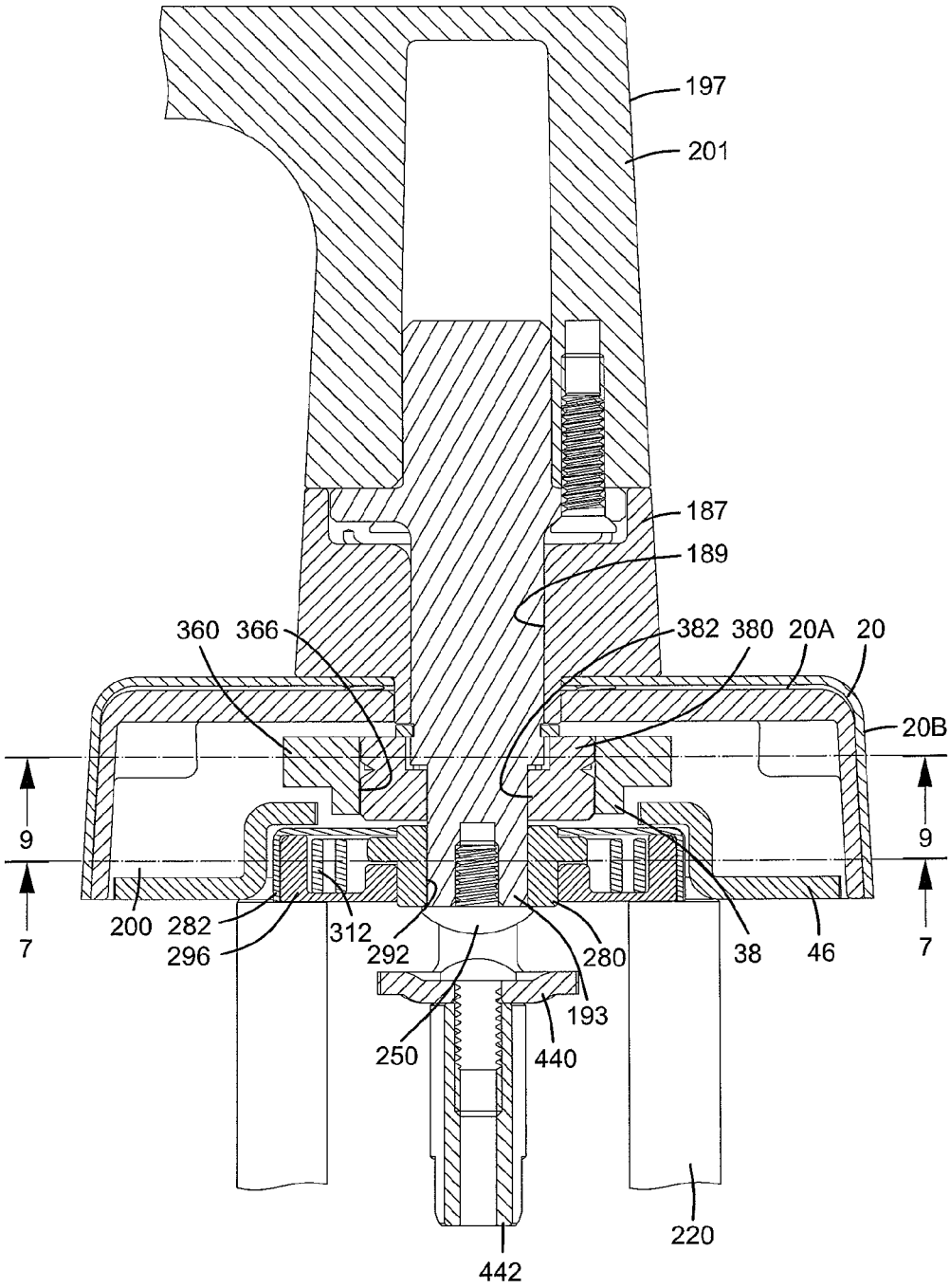
FIG. 6 shows a cross sectional view taken along section line 6-6 of FIG. 4.
Figure 7:
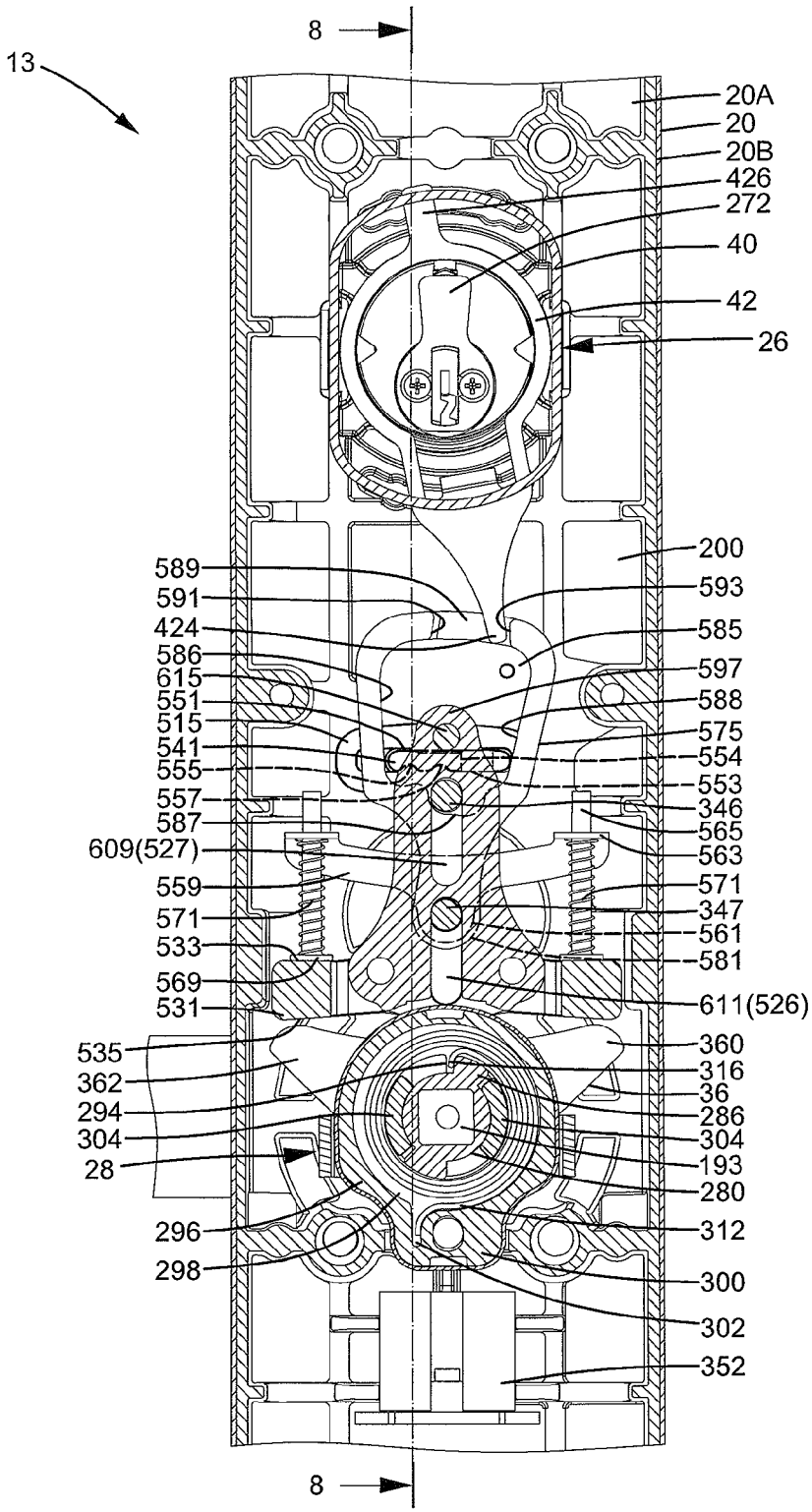
FIG. 7 shows a cross sectional view taken along section line 7-7 of FIG. 6.
Figure 8:
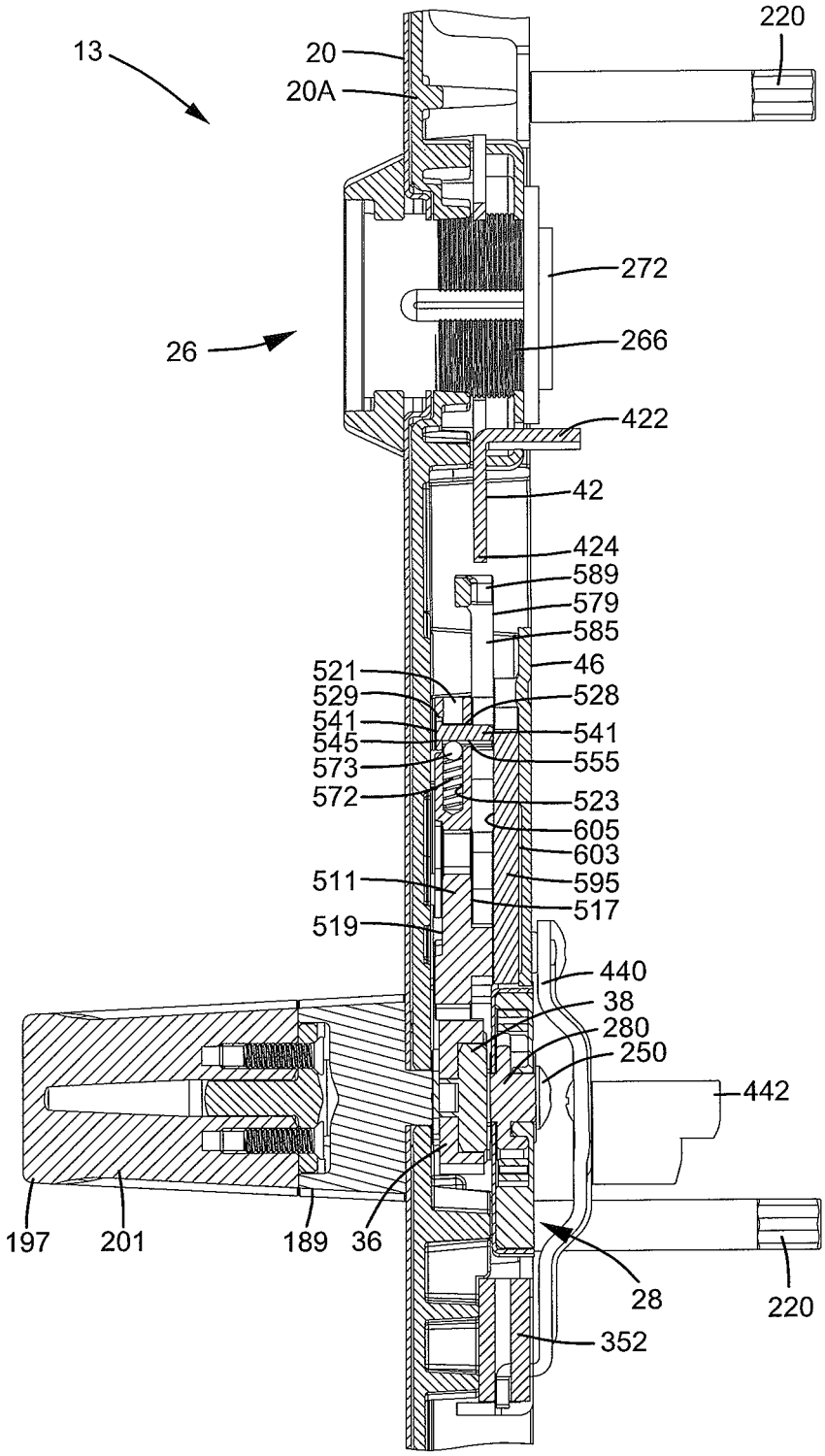
FIG. 8 shows a cross sectional view taken along section line 8-8 of FIG. 7.
Figure 15:
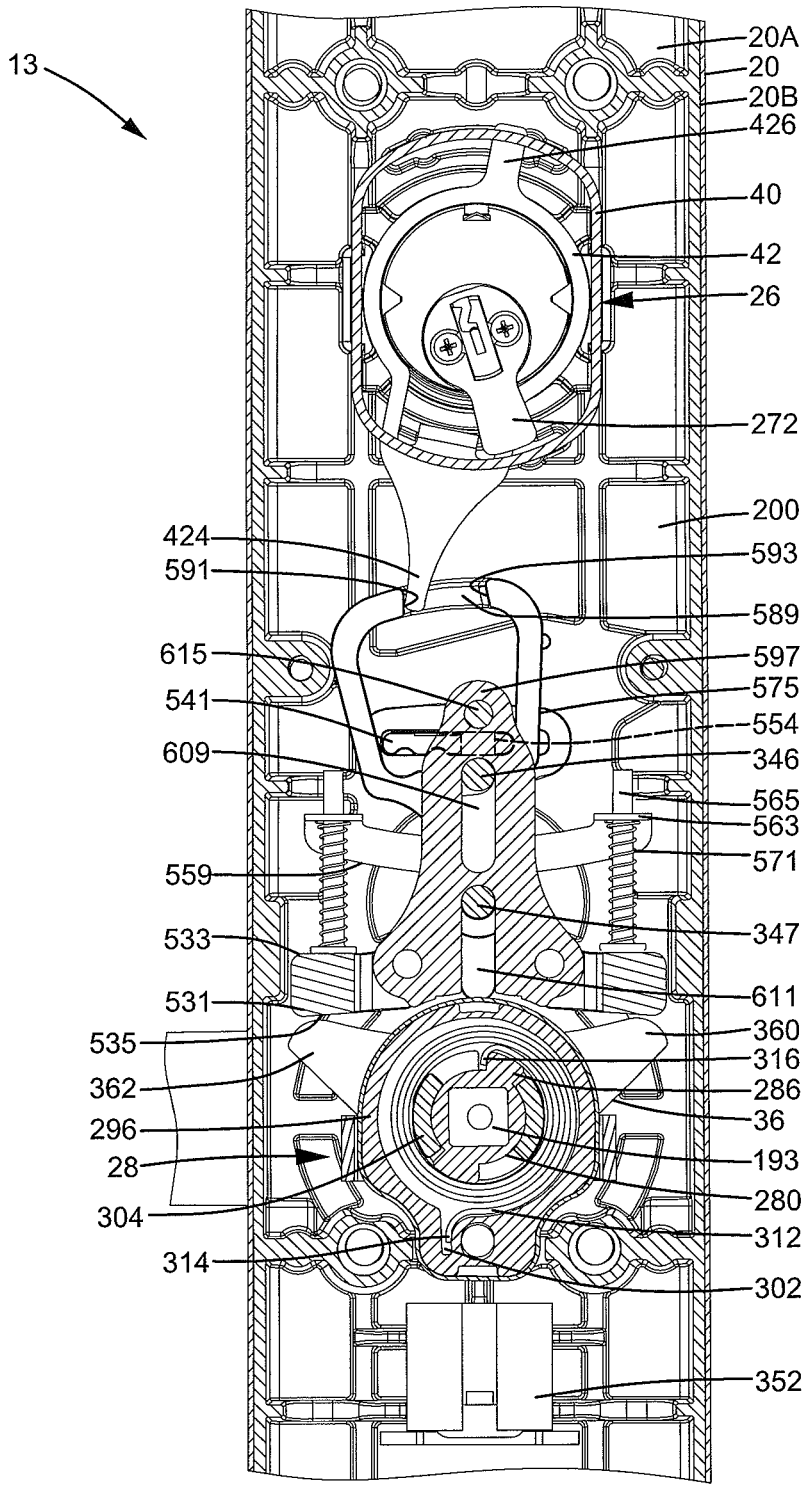
FIG. 15 shows a view similar to FIG. 8, with a locking member moved.

Block 543 of locking member 541 is slideably received in horizontal section 528 of first sliding groove 525 of sliding block 511. The other side of block 543 opposite to flange 545 is located outside of first face 517 of sliding block 511 (FIGS. 5 and 8). Flange 545 of locking member 541 is received in annular recess 529 of sliding block 511. Locking member 541 is movable in horizontal section 528 of first sliding groove 525 between a first position (FIG. 7) and a second position (FIG. 15) along second axis Y. When locking member 541 is in the first position, passage 554 of locking member 541 is not aligned with vertical section 527 of first sliding groove 525, and first groove 555 of locking member 541 is engaged with positioning member 573 to position locking member 541. When locking member 541 is in the second position, passage 554 of locking member 541 is aligned with vertical section 527 of sliding block 511, and second groove 557 of locking member 541 is engaged with positioning member 573 to position locking member 541.

Outer operational device 13 further includes a push member 575 having a pivotal portion 581 pivotably connected to second guide pin 347 of cover 20 (FIG. 5). Push member 575 includes first and second sides 577 and 579 and an opening 583 extending from first side 577 through second side 579. Opening 583 includes first and second portions 585 and 587. First portion 585 includes first and second push faces 586 and 588 facing each other. A push groove 589 is defined in first side 577 and in communication with first portion 585 of opening 583. Push groove 589 includes first and second sidewalls 591 and 593 facing each other, with first sidewall 591 located between second sidewall 593 and first push face 586, with second sidewall 593 located between first sidewall 591 and second push face 588.

Second side 579 of push member 575 abuts first face 517 of sliding block 511. First side 577 of push member 575 is flush with lateral face 537 of sliding block 511. The other side of block 543 of locking member 541 opposite to flange 545 is received in first portion 585 of opening 583 of push member 575, with first end 547 of locking member 541 abutting first push face 586 of push member 575, with second end 549 of locking member 541 abutting second push face 588 of push member 575 (FIG. 7). Sliding block 511 is movable along third axis Z between second side 579 of push member 575 and limiting plate 559. First guide pin 346 of cover 20 extends through second portion 587 of opening 583 of push member 575. Locking member 541 moves between the first and second positions when push member 575 pivots.

Outer operational device 13 further includes a cylinder 26 received in opening 208 of cover 20. Cylinder 26 includes a lock core operable by a key. Cylinder 26 includes an actuator 272 rotatable together with the lock core. Cylinder 26 further includes a threaded portion 266. Actuator 272 is located outside of space 200 of cover 20.

Outer operational device 13 further includes a mover 42 pivotably mounted around cylinder 26. Mover 42 includes a hole 420. Mover 42 further includes a limiting bar 426 extending upward from an upper end thereof and an actuating bar 424 extending downward from a lower end thereof. A tab 422 extends perpendicularly from actuating bar 424. Actuating bar 424 is received in push groove 589 of push member 575. Tab 422 of mover 42 is in a rotating path of actuator 272 of cylinder 26. Thus, the mover 42 is pivoted to drive the push member 575 when the actuator 272 pivots, causing movement of locking member 541 between the first and second positions.

Outer operational device 13 further includes a lid 40 in the form of a thin shell. Specifically, lid 40 includes two lateral walls 410 and an interconnecting wall 412 interconnected between lateral walls 410. A hole 402 is defined in interconnecting wall 412 and has a shape corresponding to body 264 of cylinder 26. Two diametrically opposed projections 406 are formed on an inner periphery of hole 402. Interconnecting wall 412 further includes an arcuate limiting groove 404 below hole 402. Lid 40 further includes an upper notch 408 in a top thereof between upper ends of lateral walls 410 and a lower notch 408 in a bottom thereof between lower ends of lateral walls 410. Lid 40 is mounted around cylinder 26, with projections 406 engaged in positioning grooves in cylinder 26, so that lid 40 and cover 20 can not rotate relative to each other and that cylinder 26 and lid 40 can not rotate relative to receiving portion 205. A washer 274 with inner threading is threadedly engaged around threaded portion 266 and abuts a face of interconnecting wall 412 of lid 40, preventing lid 40 from moving along an axial direction of body 264. Furthermore, mover 42 is rotatably mounted between cover 20 and washer 274. Thus, pivotal movement of mover 42 is limited by upper and lower notches 408 and limiting groove 404.

Outer operational device 13 further includes a connection member 595 slideably received in space 200 of cover 20. Connection member 595 includes upper and lower ends 597 and 601 and first and second surfaces 603 and 605 extending between upper and lower ends 597 and 601. An upper sliding groove 609 extends from first surface 603 through second surface 605 of connection member 595. A lower sliding groove 611 extends from first surface 603 through second surface 605 of connection member 595 and spaced from upper sliding groove 609 along first axis X. An engagement hole 607 is defined in upper end 597 of connection member 595 and extends from first surface 603 through second surface 605. Two pegs 613 are formed on first surface 603 of connection member 595 and spaced from each other along second axis Y, with lower sliding groove 611 located between pegs 613.

Figure 13:
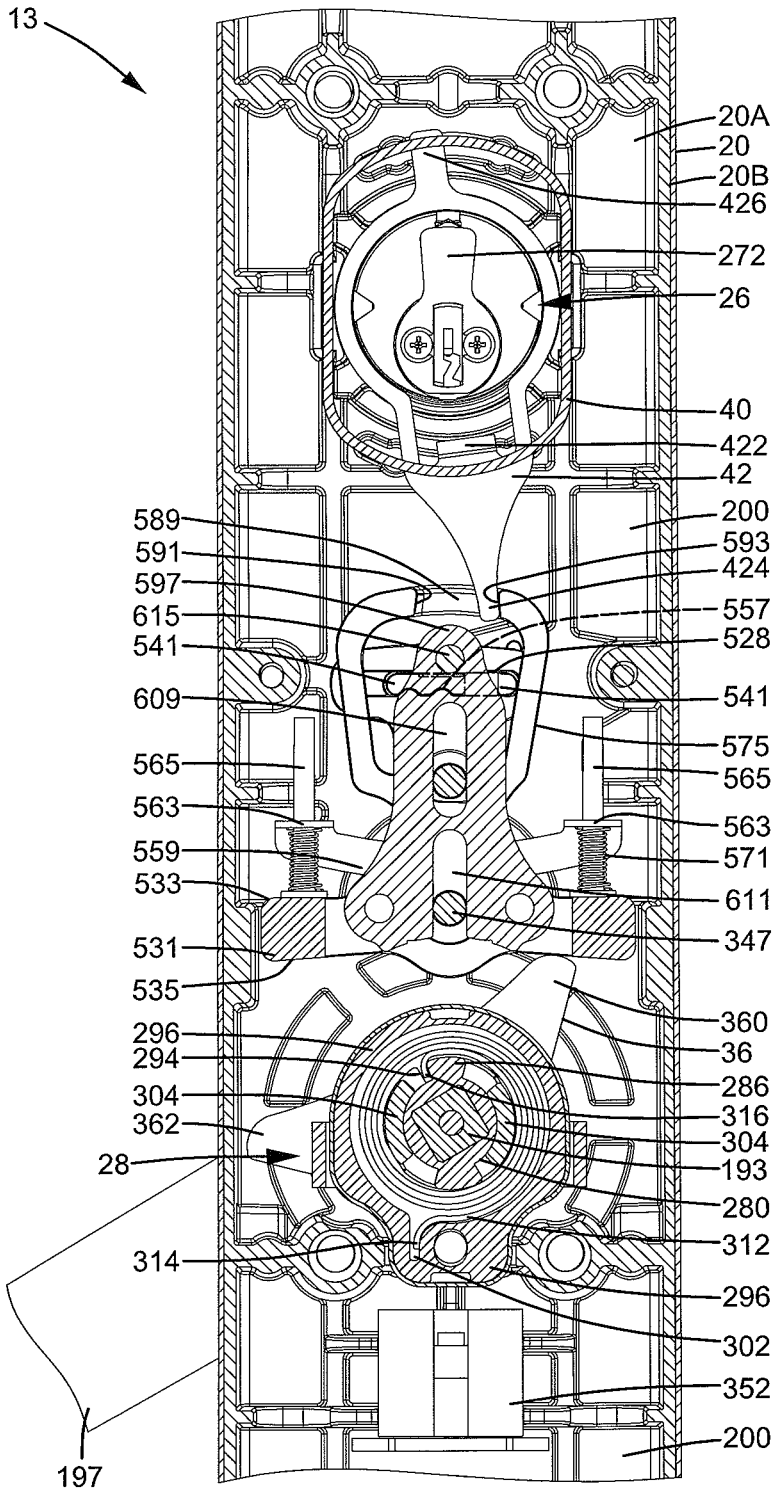
FIG. 13 shows a view similar to FIG. 8, with a handle rotated, with a sliding block moved upward.

Second surface 605 of connection member 595 abuts first side 577 of push member 575 and lateral face 537 of each leg 531. Push member 575 is located between connection member 595 and sliding block 511 along third axis Z. First guide pin 346 of cover 20 is received in upper sliding groove 609 of connection member 595. Second guide pin 347 is received in lower sliding groove 611. Connection member 595 is movable along first axis X between a releasing position (FIG. 7) and a push position (FIG. 13). When connection member 595 is in the releasing position while sliding block 511 is in the lower position, upper sliding groove 609 of connection member 595 is aligned with vertical section 527 of first sliding groove 525 of sliding block 511, and lower sliding groove 611 is aligned with second sliding groove 526 of sliding block 511 (FIG. 5).

A follower rod 615 has an end engaged in engagement hole 607 of connection member 595. The other end of follower rod 615 is located outside of second surface 605 of connection member 595 and located above block 543 of locking member 541 (FIGS. 5 and 7). When locking member 541 is in the first position, a position of passage 554 of locking member 541 along second axis Y is not aligned with a position of follower rod 615 along second axis Y, such that movement of locking member 541 along first axis X causes movement of follower rod 615 along first axis X. When locking member 541 is in the second position, the position of passage 554 of locking member 541 along second axis Y is aligned with the position of follower rod 615 along second axis Y, such that movement of locking member 541 along first axis X does not cause movement of follower rod 615 along first axis X.

Outer operational device 13 further includes an inner lid 46 having an opening 462 through which coupling end 193 of spindle 191 extends. Two bends 466 are formed on an inner periphery of opening 462. Inner lid 46 further includes two parallel, spaced, elongated slots 460 above opening 462. Inner lid 46 further includes a support 464 below opening 462. Support 464 is formed by bending a portion of inner lid 46 and includes a vertical section 470 and a horizontal section 472. Inner lid 46 abuts supports 217 and engagement portions 218 of cover 20, and fasteners are extended through inner lid 46 into screw holes in supports 217. Two of mounting posts 220 are extended through inner lid 46 into screw holes in engagement portions 218. Thus, inner lid 46 is fixed in space 200 of cover 20. Vertical section 470 and horizontal section 472 of support 464 retain guiding block 352 in place. Each peg 613 of connection member 595 is received in one of elongated slots 460 of inner lid 46.

Outer operational device 13 further includes a returning device 28 having a body 296 having a non-circular outer periphery. Body 296 includes a lobe 300 on a lower end thereof and having rectangular cross sections. Body 296 further includes a compartment 298 in a side thereof. Compartment 298 forms an engaging groove 302 in lobe 300. A bottom wall defining compartment 298 includes a pivot hole 308. Two limiting blocks 304 are formed on the side of body 296 along a periphery of pivot hole 308. Each limiting block 304 includes an end 306. Furthermore, each limiting block 304 has a height to the side of body 296 smaller than or equal to a depth of compartment 298. A housing 282 slightly larger than body 296 is mounted to the side of body 296 to cover compartment 298. Housing 282 includes an axial hole 284 aligned with pivot hole 308.

Returning device 28 further includes a substantially cylindrical rotatable member 280 having a flange 288 on an intermediate portion of an outer periphery thereof. Two pivotal sections 290 are formed on opposite sides of flange 288. Also formed on the outer periphery of rotatable member 280 are first and second blocks 286 adjacent two ends of flange 288. A slit 294 is formed between flange 288 and first block 286. Rotatable member 280 further includes a non-circular hole 292 through which coupling end 193 of spindle 191 extends. Pivotal sections 290 are respectively and pivotably received in pivot hole 308 of body 296 and axial hole 284 of housing 282 with first and second locks 286 located between limiting blocks 304. The spacing between limiting blocks 304 and first and second locks 286 limits rotation of rotatable member 280.

Returning device 28 further includes an elastic element 312 in the form of a spiral spring having a spiral section, a first tang 314 outside of the spiral section, and a second tang 316 inside of the spiral section. The spiral section of elastic element 312 is mounted around limiting blocks 304 and located in compartment 298, with first tang 314 abutting against a wall of engaging groove 302, with second tang 316 received in slit 294 of rotatable member 280 and abutting against a side of first block 286 adjacent slit 294. Thus, first tang 314 is fixed to body 296, and second tang 316 is fixed in slit 294. Rotatable member 280 is biased by elastic element 312 so that each of first and second blocks 286 presses against end 306 of one of limiting blocks 304. In this state, lever 199 of handle 197 is in a horizontal state, with rotatable member 280 in its initial position. When rotatable member 280 is rotated, first block 286 adjacent slit 294 presses against second tang 316 of elastic element 312 to store the restoring force.

Returning device 28 is received in opening 462 of inner lid 46 and abuts against bends 466. Lobe 300 of body 296 is received in second groove 219 of cover 20, avoiding rotation of body 296 about third axis Z. Coupling end 193 of spindle 191 is extended through non-circular hole 292 of rotatable member 280. A fastener 250 is threadedly engaged in a screw hole in an end face of coupling end 193 and includes a head abutting against rotatable member 280, such that returning device 28 can not move along coupling end 193. Thus, follower 38 and actuating member 36 are retained in place. Due to non-circular coupling between coupling end 193 of spindle 191 and rotatable member 280, elastic element 312 is twisted by rotatable member 280 when handle 197 is rotated. When handle 197 is released, elastic element 312 returns rotatable member 280 to its initial position and returns handle 197 to its initial, horizontal position. Limiting blocks 304 limit rotational movement of handle 197 to be about 45° in either direction.

Outer operational device 13 further includes a substantially T-shaped driving member 44 having a base portion 440 and a pressing rod 442. Base portion 440 includes an engaging portion 448 engaged with pegs 613 of connection member 595. Base portion 440 further includes a guiding end 444 slideably received in sliding groove 353 of guiding block 352. Base portion 440 further includes an intermediate portion 441 between engaging portion 448 and guiding end 444. Intermediate portion 441 includes an engagement groove 449 including two lateral walls 449A each having a plurality of teeth 450 spaced from each other along first axis X.

Pressing rod 442 is detachably mounted to base portion 440 and includes a driving end 445 and an engagement end 443. An insertion block 446 is formed on an end face of engagement end 443 and includes two lateral sides spaced from each other along the second axis Y. A plurality of teeth 447 is formed on each lateral side of insertion block 446 and spaced from each other along first axis X. A screw hole 452 is defined in the end face of engagement end 443 and spaced from insertion block 446 along first axis X. A length of insertion block 446 along first axis X is smaller than a length of engagement groove 449 along first axis X. After adjustment of the position of pressing rod 442 relative to engagement groove 449 of base portion 440, insertion block 446 of pressing rod 442 is engaged in engagement groove 449, with teeth 447 of insertion block 446 meshed with teeth 450 of engagement groove 449. A screw 451 is extended through engagement groove 449 into screw hole 452, fixing pressing rod 442 in base portion 440. Thus, base portion 440 of driving member 44 moves together with pressing rod 442 when connection member 595 moves between the releasing position (FIG. 7) and the push portion (FIG. 13).

In the form shown, outer operational device 13 is mounted to a door 10. Door 10 includes an inner side 10A and an outer side 10B. A mounting hole 105 is defined between inner side 10A and outer side 10B. Door 10 further includes a plurality of first holes 102, with each first hole 102 extending from inner side 10A through outer side 10B. A second hole 104 and a third hole 106 are defined in outer side 10B of door 10. A fourth hole 107 is defined in outer side 10A of door 10. Each of second, third, and fourth holes 104, 106, and 107 is in communication with mounting hole 105. A latch device 12 is mounted in mounting hole 105. An inner operational device 18 is mounted to inner side 10A of door 10. Outer operational device 13 is mounted to outer side 10B of door 10. Latch device 12 and inner operational device 18 can be of any desired form as conventional including but not limited to of a commercially available type.

In the form shown, latch device 12 includes a case 122 mounted in mounting hole 105 of door 10. Case 122 includes an opening 123 in a lower end thereof and a sliding groove 127 in a face thereof. A retractor 120 is slideably received in case 122 and partially received in sliding groove 127. A spring 125 is mounted between retractor 120 and a latch 124, with latch 124 movable between a latching position outside of case 122 and an unlatching position in case 122.

An unlocking member 148 is pivotably mounted in case 122 and located below latch 124. Unlocking member 148 is substantially T-shaped and includes first and second arms 152 and 154. A push rod 144 is mounted in case 122 and abuts unlocking member 148. Push rod 144 has an end 146 adjacent to retractor 120. The other end of push rod 144 is pivotably connected to case 122. First arm 152 of unlocking member 148 abuts push rod 144. Second arm 154 is located in opening 123.

Figure 12:
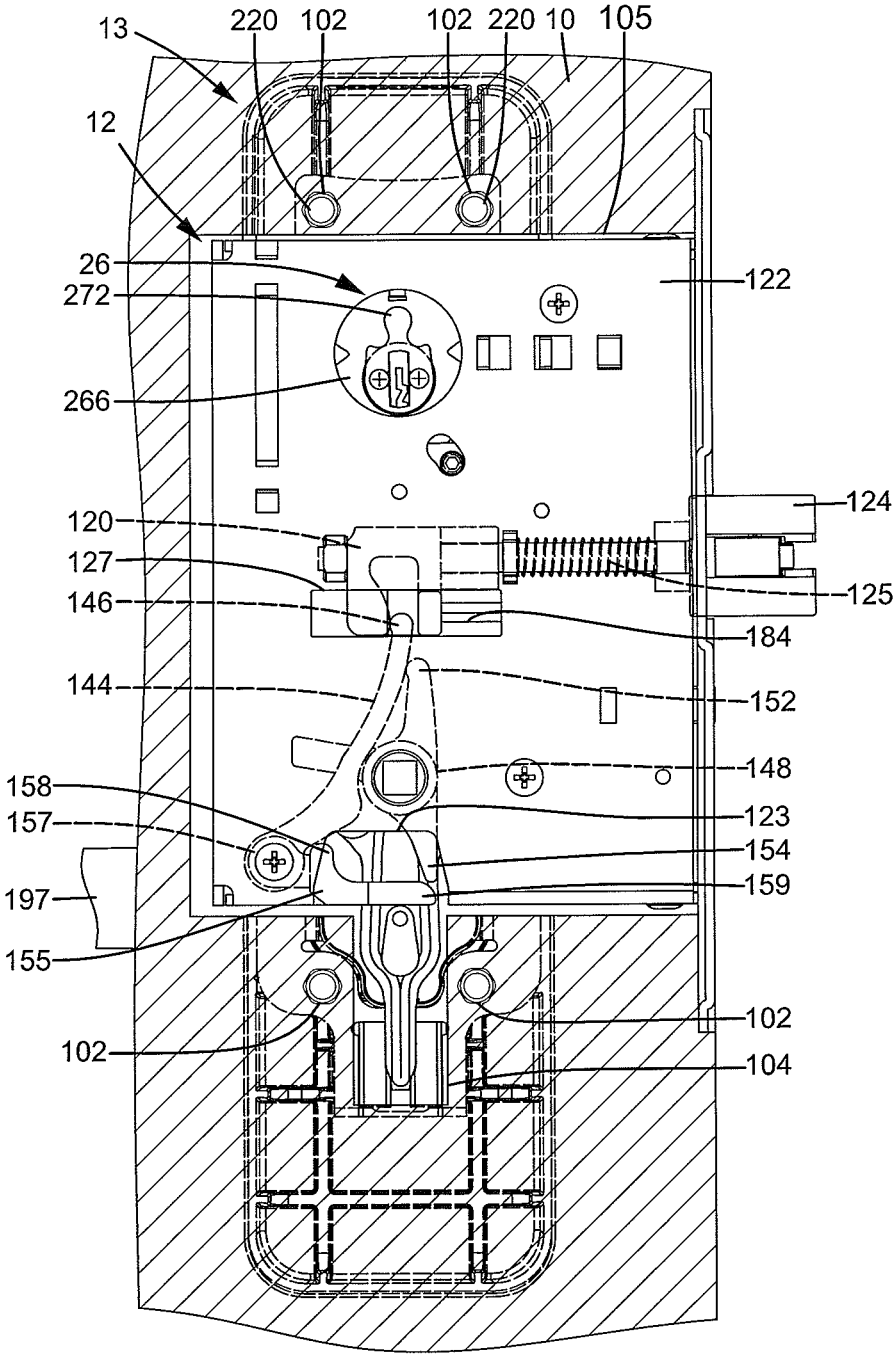
FIG. 12 shows a view similar to FIG. 11, with a pressing rod moved to a proper position.
Figure 14:
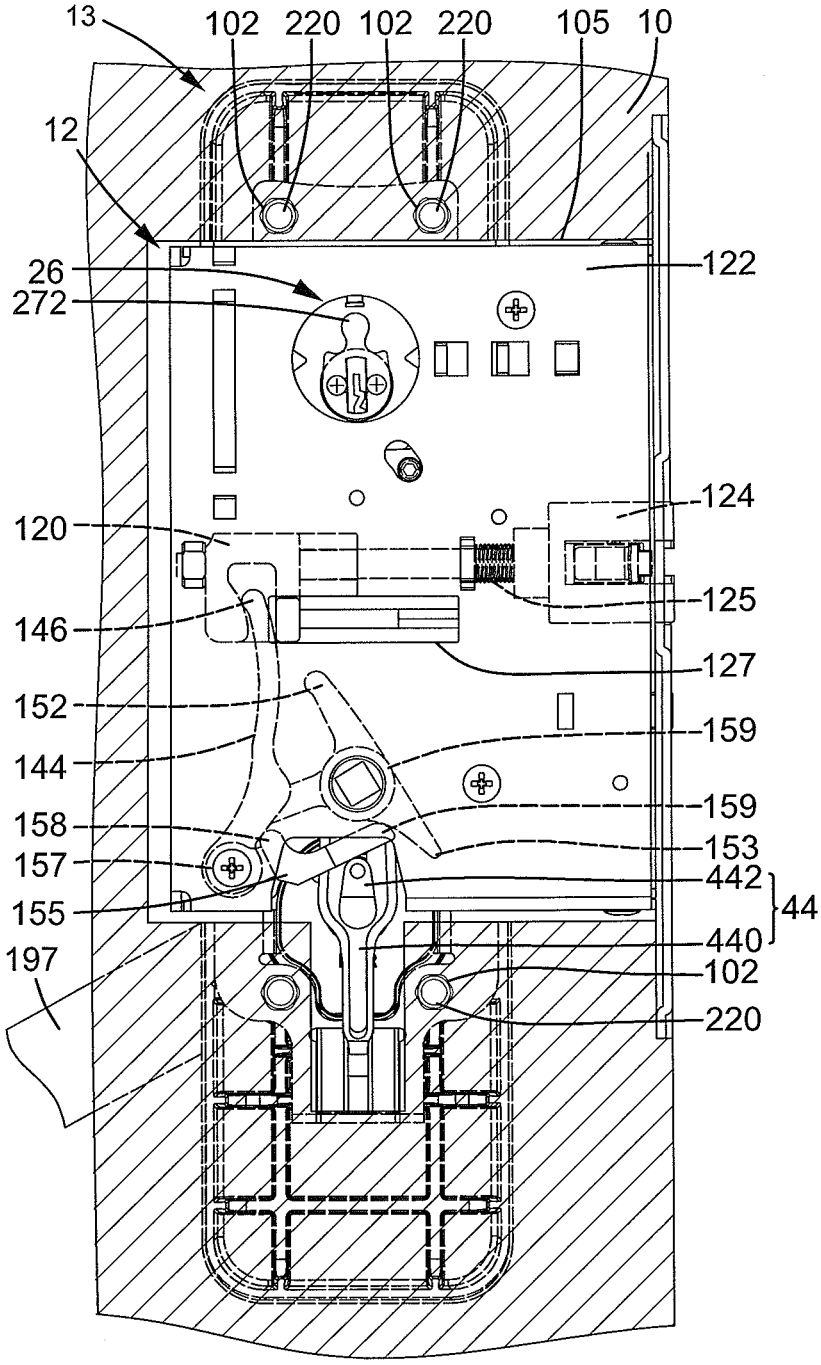
FIG. 14 shows a view similar to FIG. 11, with a latch retracted.

A pressing member 155 is mounted in case 122 and located below unlocking member 148 and push rod 144. Pressing member 155 includes a pivotal end 157 pivotably connected to case 122. Pressing member 155 further includes a first pressing end 158 adjacent to the pivotal end 157 and a second pressing end 159 distant to the pivotal end 157. First pressing end 158 abuts a lower portion of push rod 144. Second pressing member 155 is received in opening 123 and located below second arm 154 of unlocking member 148 (FIG. 12). When pressing member 155 pivots in a counterclockwise direction in FIG. 12, first pressing end 158 of pressing member 155 drives push rod 144 to pivot and causes movement of retractor 120 to retract latch 124 from the latching position to the unlatching position. At the same time, second pressing end 159 of pressing member 155 pushes second arm 154 of unlocking member 148, causing pivotal movement of unlocking member 148 in the counterclockwise direction (FIG. 14).

In the form shown, inner operational device 18 includes a base 180 and a driving rod 184 pivotably connected to base 180. A linking rod 186 is slideably mounted to base 180. An operative member 182 is mounted outside of base 180 and operatively connected to linking rod 186. An end of driving rod 184 extends through fourth hole 107 of door 10 into case 122 and is located adjacent to retractor 120. When operative member 182 is pressed to actuate linking rod 186 to pivot driving rod 184, retractor 120 is moved to retract latch 124.

Figure 10:
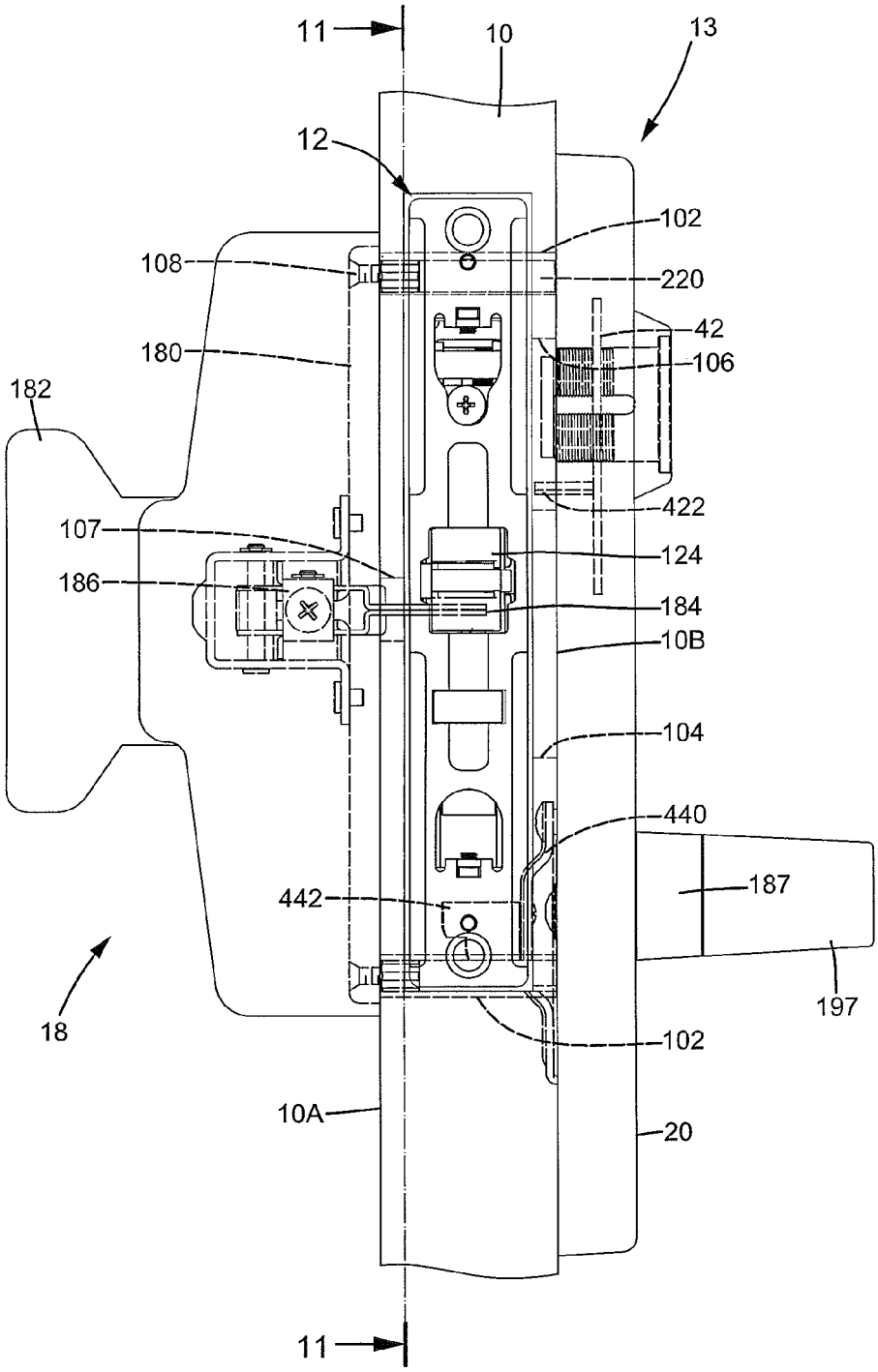
FIG. 10 shows a partial, side elevational view of a door, with a lock including the outer operational device mounted to the door.

Cover 20 of outer operational device 13 abuts outer side 10B of door 10. Each mounting post 220 extends through one of first holes 102 of door 10 to a position adjacent to base 180 of inner operational device 18. Fasteners 108 are extended through base 180 into mounting posts 220, fixing inner and outer operational devices 18 and 13 to inner and outer sides 10A and 10B of door 10 (FIG. 10). Actuator 272 of cylinder 26 and tab 422 of mover 42 are located in third hole 106 of door 10. Base portion 440 of driving member 44 is located in second hole 104 of door 10. Driving end 445 of pressing rod 442 is located in mounting hole 105 of door 10 and located below pressing member 155 of latch device 12.

Figure 9:
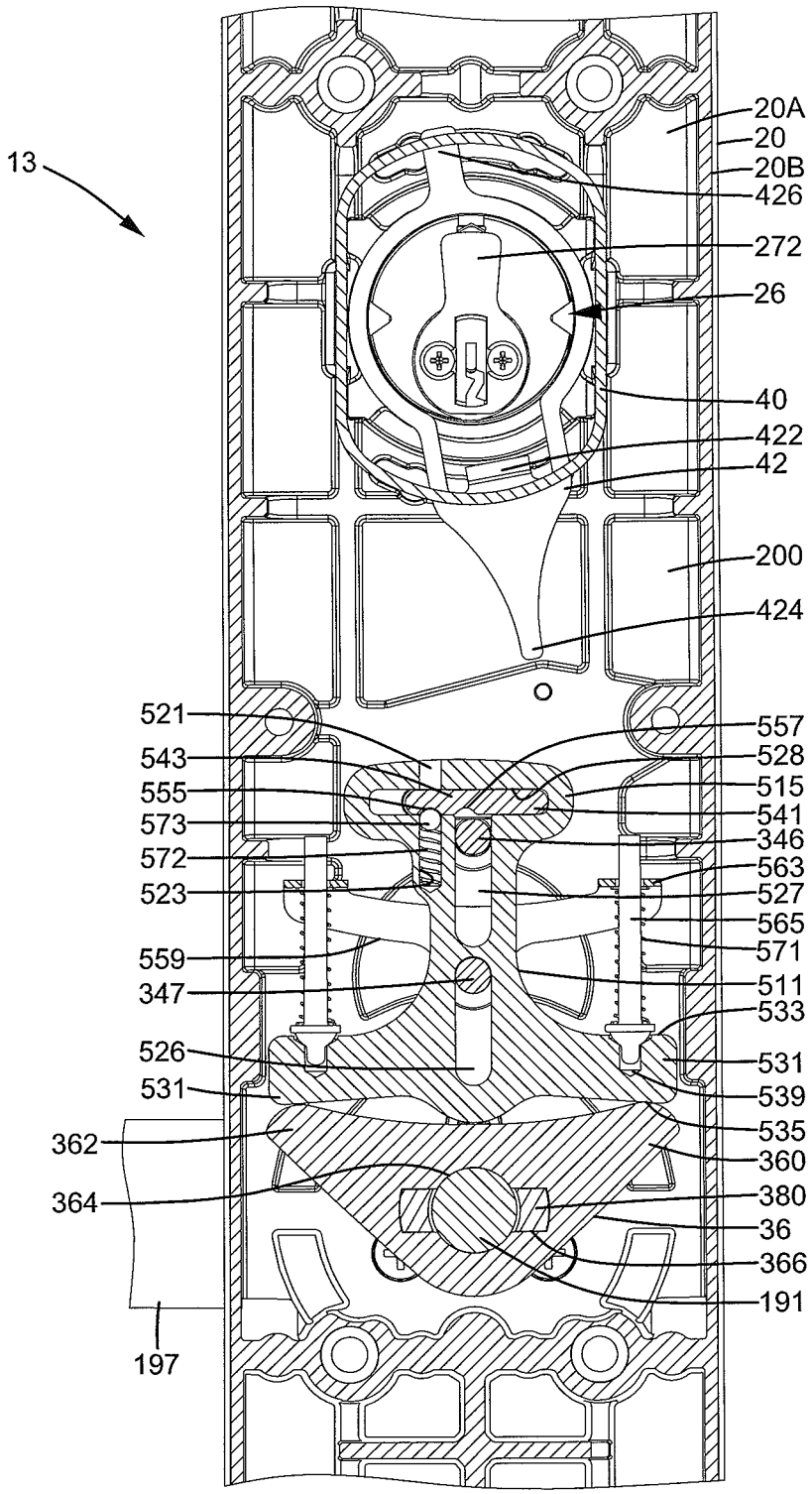
FIG. 9 shows a cross sectional view taken along section line 9-9 of FIG. 6.

Now that the basic construction of outer operational device 13 of the present invention has been explained, the operation and some of the advantages of outer operational device 13 can be set forth and appreciated. In particular, for the sake of explanation, it will be assumed that lever 199 of handle 197 is in a horizontal position (FIG. 12). Sliding block 511 is the lower position (FIG. 9). Connection member 595 is in the releasing position (FIG. 7). Locking member 541 is in the first position. Thus, the position of passage 554 of locking member 541 along second axis Y is not aligned with the position of follower rod 615 along second axis Y. Outer operational device 13 is in an unlocked state (FIG. 7).

Figure 11:
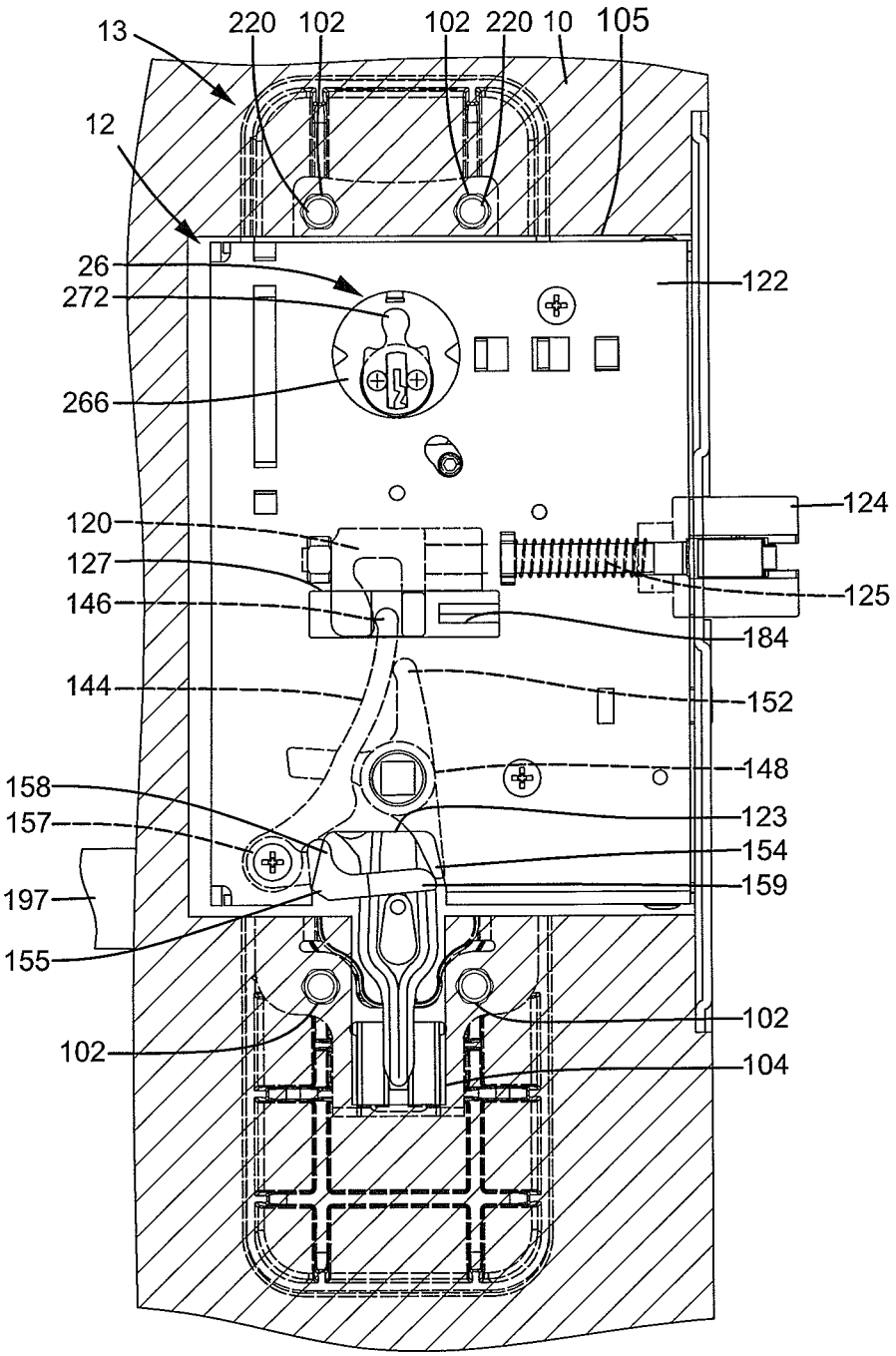
FIG. 11 shows a cross sectional view taken along section line 11-11 of FIG. 10.

After mounting outer operational device 13 to door 10, pressing rod 442 of driving member 44 may not be exactly below second pressing end 159 of pressing member 155 (FIG. 11), such that pressing member 155 is pressed against by pressing rod 442 to pivot unlocking member 148 and push rod 144 through a small angle, and latch 124 is moved to a position between the latching position and the unlatching position. Thus, it is necessary to move pressing rod 442 downward along first axis X to a position abutting the bottom of pressing member 155 without causing pivotal movement of pressing member 155 to assure latch 124 in the latching position. Specifically, driving member 44 and pressing rod 442 are detached. Then, pressing rod 442 is moved towards guiding end 444. Next, teeth 447 of insertion block 446 of pressing rod 442 are engaged with teeth 450 of engagement groove 449. Pressing rod 442 is fixed in place by screw 451. Finally, driving member 44 is engaged with connection member 595. Thus, pressing rod 442 of driving member 44 is adjusted to a position abutting the bottom of pressing member 155 without causing pivotal movement of pressing member 155, with latch 124 in the latching position (FIG. 12). Similarly, if pressing rod 442 is spaced from pressing member 155 along first axis X after mounting outer operational device 13 to door 10, driving member 44 can be detached to allow adjustment of the pressing rod 442 to the proper position abutting pressing member 155.

With reference to FIG. 12, pressing rod 442 of driving member 44 is in the position abutting the bottom of pressing member 155 without causing pivotal movement of pressing member 155, and outer operational device 13 is in the unlocked state. In a case that it is desired to move latch 124 from the latching position to the unlatching position, handle 197 is pivoted to cause pivotal movement of spindle 191, which, in turn, causes pivotal movement of actuating member 36. First end 360 of actuating member 36 pushes lower face 535 of first leg 531 of sliding block 511 to move sliding block 511 from the lower position to the upper position (FIG. 13). Upper face 551 of locking member 541 presses against follower rod 615 to move connection member 595 from the releasing position (FIG. 7) to the push position (FIG. 13). Thus, pressing rod 442 of driving member 44 presses against pressing member 155. With locking member 541 in the first position and with sliding block 511 in the upper position, connection member 595 is in the push position (FIG. 13), and if pressing rod 442 is actuated to push pressing member 155, push rod 144 is moved to press against retractor 120, retracting latch 124 to the unlatching position (FIG. 14).

Figure 16:
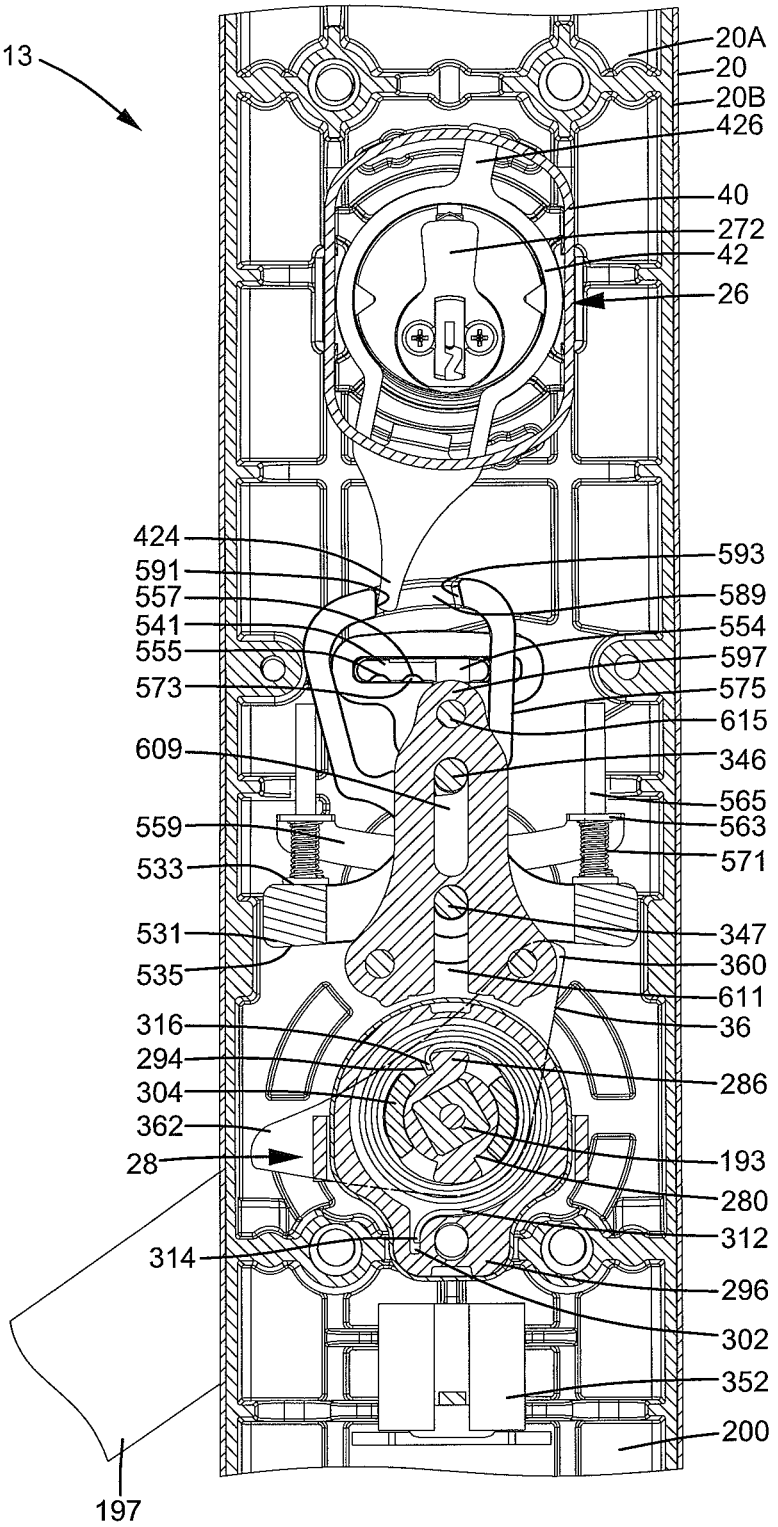
FIG. 16 shows a view similar to FIG. 15, with the handle rotated, with the sliding block moved upward, and with a connection member unmoved.
Figure 17:
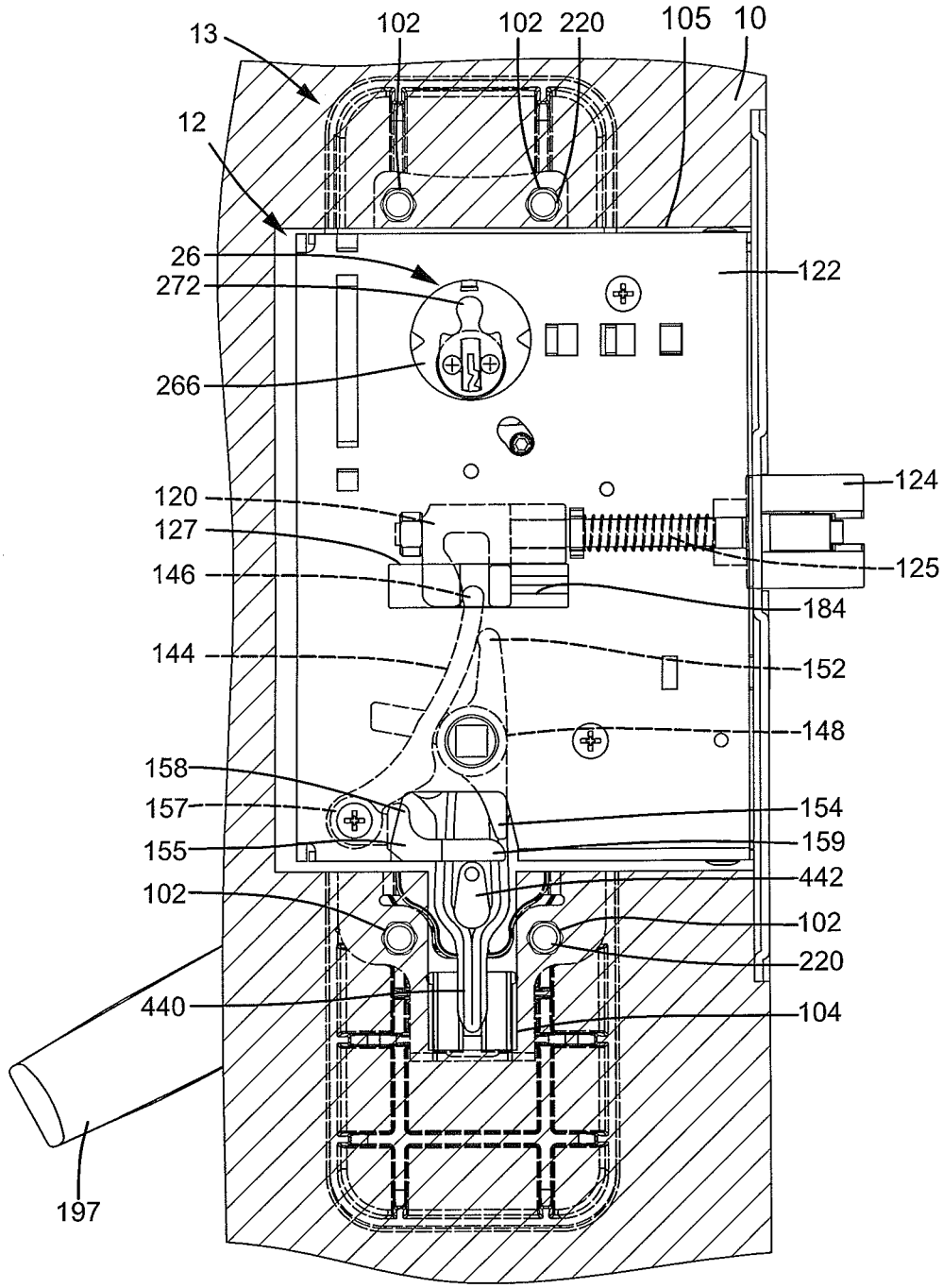
FIG. 17 shows a view similar to FIG. 12, with the handle rotated, with the latch remained in the latching position.

If it is desired to lock outer operational device 13 while door 10 is closed (such that latch 124 can not be retracted when handle 197 is pivoted), a key is used to rotate actuator 272 of cylinder 26 to push tab 422 of mover 42, such that tab 422 of mover 42 presses against first sidewall 591 of push groove 589. Thus, second push face 588 of push member 575 presses against second end 549 of locking member 541, moving locking member 541 from the first position (FIG. 7) to the second position (FIG. 15) in which the position of passage 554 of locking member 541 along second axis Y is aligned with the position of follower rod 615 along second axis Y, and outer operational device 13 is in a locked state (FIG. 16). When locking member 541 is in the second position, if handle 197 is pivoted, sliding block 511 moves from the lower position to the upper position. However, since passage 554 of locking member 541 can pass through follower rod 615 along first axis X, connection member 595 is not moved. Namely, connection member 595 is still in the releasing position, pressing rod 442 is not moved, and latch 124 remains in the latching position (FIG. 17).

When the key is rotated in a reverse direction and, thus, moves actuator 272 in the reverse direction, actuating bar 424 of mover 42 presses against second sidewall 593 of push groove 589 of push member 575. First portion 585 of opening 583 of push member 575 presses against first end 547 of locking member 541, moving locking member 541 to the first position.

Locking member 541 movable between the first and second positions controls movement of latch 124 when handle 197 is pivoted. Specifically, no matter in the locked state or unlocked state, sliding block 511 of outer operational device 13 is moved when handle 197 is pivoted, preventing damage to the components of outer operational device 13 if handle 197 is pivoted while outer operational device 13 is in the locked state.

Driving member 44 allows adjustment of pressing rod 42 to abut the bottom of pressing member 155 of latch device 12 through easy operation, assuring reliable operation of latch 124.

Now that the basic teachings of the present invention have been explained, many extensions and variations will be obvious to one having ordinary skill in the art. For example, outer operational device 13 does not have to include returning device 28. In this case, pivotal movement of handle 197 causes movement of sliding block 511 from the lower position to the upper position and compresses springs 571. When the force applied to handle 197 vanishes, springs 571 press against flanges 569 of guiding rods 565 to return handle 197 while returning sliding block 511 to the lower position. Furthermore, each guiding rod 565 does not have to include flange 569. In this case, each spring 571 has an end abutting upper face 533 of one of legs 531 without adversely affecting the function of returning sliding block 511. Further, outer operational device 13 can include only one guiding rod 565 and only one spring 571. Limiting plate 559 can include only one wing 563. In this case, sliding block 511 can be guided by first and second guide pins 346 and 347 to move smoothly from the upper position to the lower position even though only one spring 571 and only one guiding rod 565 are used. Further, outer operational device 13 does not have to include follower 38, and connecting hole 364 of actuating member 36 includes non-circular cross sections to engage with coupling end 193 of spindle 191, allowing jointing pivotal movement of handle 197, spindle 191, and actuating member 36 when handle 197 pivots.

Furthermore, teeth 450 of base portion 440 of driving member 44 can be formed on only one of lateral walls 449A of engagement groove 449, and pressing rod 442 can include teeth 447 on a side of insertion block 446 for engagement with teeth 450.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An outer operational device for a door lock, comprising, in combination:

a cover (20) including a space (200) delimited by a sidewall (20A), with a first guide pin (346) and a second guide pin (347) formed on the sidewall (20A), with the sidewall (20A) including a receiving portion (205) having an opening (208), with the sidewall (20A) further including an engaging hole (214), with the first and second guide pins (346, 347) located between the receiving portion (205) and the engaging hole (214), with the cover (20) adapted to be mounted to an outer side (10B) of a door (10);

a spindle (191) pivotably received in the engaging hole (214) of the cover (20), with the spindle (191) including a coupling end (193) received in the space (200) of the cover (20);

a handle (197) located outside of the cover (20) and fixed to the spindle (191), with the handle (197) and the spindle (191) jointly pivotable;

an actuating member (36) received in the space (200) and mounted to the spindle (191), with the actuating member (36) and the spindle (191) jointly pivotable, with the actuating member (36) including a first end (360);

a limiting plate (559) received in the space (200) and engaged with the second guide pin (347), with the limiting plate (559) including a wing (563);

a sliding block (511) received in the space (200) and slideable along a first axis (X), with the sliding block (511) including first and second faces (517, 519), with first and second sliding grooves (525, 526) extending from the first face (517) through the second face (519) of the sliding block (511), with the first sliding groove (525) including a vertical section (527) extending along the first axis (X) and a horizontal section (528) extending along a second axis (Y) perpendicular to the first axis (X), with the sliding block (511) further including a leg (531) having an upper face (533) and a lower face (535) spaced from the upper face (533) along the first axis (X), with the first guide pin (346) of the cover (20) slideably extending through the vertical section (527) of the first sliding groove (525) of the sliding block (511), with the second guide pin (347) slideably extending through the second sliding groove (526) of the sliding block (511), with the limiting plate (559) located between the second face (519) of the sliding block (511) and the sidewall (20A) of the cover (20) along a third axis (Z) perpendicular to the first and second axes (X, Y), with the wing (563) of the limiting plate (559) aligned with the leg (531) of the sliding block (511), with the lower face (535) of the leg (531) abutting the first end (360) of the actuating member (36), with the lower face (535) of the leg (531) being pressed against by the first end (350) of the actuating member (36) when the actuating member (36) pivots, causing movement of the sliding block (511) from a lower position to an upper position along the first axis (X);

a spring (571) having two ends respectively abutting against the wing (563) of the limiting plate (559) and the leg (531), with the spring (571) biasing the sliding block (511) from the upper position to the lower position;

a locking member (541) slideably received in the horizontal section (528) of the first sliding groove (525) of the sliding block (511), with the locking member (541) including a block (543) having first and second ends (547, 549) spaced from each other along the second axis (Y), with the block (543) further including upper and lower faces (551, 553) extending between the first and second ends (547, 549) of the block (543), with a passage (554) extending from the upper face (551) through the lower face (553) of the block (543), with the block (543) having a side located outside of the horizontal section (528) of the first sliding groove (525) of the sliding block (511), with the locking member (541) movable between first and second positions along the second axis (Y);

a push member (575) pivotably connected to the second guide pin (347) of the cover (20), with the push member (575) including first and second sides (577, 579) spaced from each other along the third axis (Z), with an opening (583) extending from the first side (577) through the second side (579) of the push member (575), with the opening (583) including first and second push faces (586, 588) spaced from each other along the second axis (Y), with a push groove (589) defined in the first side (577) of the push member (575), with the push groove (589) including first and second sidewalls (591, 593) facing each other, with the first sidewall (591) located between the second sidewall (593) and the first push face (586), with the second sidewall (593) located between the first sidewall (591) and the second push face (588), with the side of the block (543) of the locking member (541) received in the opening (583) of the push member (575), with the first end (547) of the locking member (541) abutting the first push face (586) of the push member (575), with the second end (549) of the locking member (541) abutting the second push face (588) of the push member (575), with the sliding block (511) located between the second side (579) of the push member (575) and the limiting plate (559) along the third axis (Z), with the locking member (541) moving between the first and second positions when the push member (575) pivots;

a cylinder (26) mounted in the opening (208) of the cover (20), with the cylinder (26) including an actuator (272), with the actuator (272) adapted to pivot through operation by a key;

a mover (42) pivotably mounted around the cylinder (26) and including an actuating bar (424) received in the push groove (589) of the push member (575), with the mover (42) further including a tab (422) operably connected to the actuator (272), with the push member (575) pivoting when the actuator (272) pivots;

a connection member (595) slideably received in the space (200), with the connection member (595) including upper and lower ends (597, 601) spaced from each other along the first axis (X), with the connection member (595) further including first and second surfaces (603, 605) extending between the upper and lower ends (597, 601) of the connection member (595), with the connection member (595) movable between a push position and a releasing position along the first axis (X);

a follower rod (615) including an end fixed to the connection member (595), with the follower rod (615) located above the upper face (551) of the locking member (541) when the sliding block (511) is in the lower position;

a driving member (44) fixed to the first surface (603) of the connection member (595), with the driving member (44) including a pressing rod (442) adapted to be operatively connected to a latch (124) of a latch device (12) mounted to the door (10), wherein when the actuating bar (424) of the mover (42) presses against the first sidewall (591) of the push member (575) while the locking member (541) is in the first position, the second push face (588) of the push member (575) presses against the second end (549) of the locking member (541), moving the locking member (541) from the first position to the second position, and a position of the passage (554) of the locking member (541) along the second axis (Y) is aligned with a position of the follower rod (615) along the second axis (Y), wherein when the actuating bar (424) of the mover (42) presses against the second sidewall (593) of the push member (575) while the locking member (541) is in the second position, the first push face (586) of the push member (575) presses against the first end (547) of the locking member (541), moving the locking member (541) from the second position to the first position, and the position of the passage (554) of the locking member (541) along the second axis (Y) is not aligned with the position of the follower rod (615) along the second axis (Y), wherein with the locking member (541) in the first position, when the handle (197) is pivoted to move the sliding block (511) from the lower position to the upper position and compresses the spring (571), the locking member (541) presses against the follower rod (615) to move the connection member (595) from the releasing position to the push position, the pressing rod (442) is adapted to move the latch (124) from a latching position outside of the door (10) to an unlatching position received in the door (10), wherein with the locking member (541) in the second position, when the handle (197) is pivoted to move the sliding block (511) from the lower position to the upper position and compresses the spring (571), the passage (554) of the locking member (541) movably receives the follower rod (615), the connection member (595) remains in the releasing position without moving the pressing rod (442), the latch (124) is adapted to remain in the latching position.

2. The outer operational device as claimed in claim 1, with the sliding block (511) further including a receptacle (523) in a wall of the horizontal section (528) of the first sliding groove (511), with the locking member (541) further including first and second grooves (555, 557), with the second groove (557) located between the first groove (555) and the passage (554) along the second axis (Y), with another spring (572) and a positioning member (573) received in the receptacle (523), with the positioning member (573) biased by the other spring (572) into the horizontal section (528) of the first sliding groove (511), wherein when the locking member (541) is in the first position, the other spring (572) biases the positioning member (573) to engage with the first groove (555) to retain the locking member (541) in the first position, wherein when the locking member (541) is in the second position, the other spring (572) biases the positioning member (573) to engage with the second groove (557) to retain the locking member (541) in the second position.

3. The outer operational device as claimed in claim 1, with an annular recess (529) defined in the second face (519) of the sliding block (511) and surrounding the horizontal section (528) of the first sliding groove (525), with a flange (545) formed on another side of the block (543) of the locking member (541), with the flange (545) of the locking member (541) received in the annular recess (529), preventing the locking member (541) from disengaging from the sliding block (511) by moving the locking member (541) away from the sidewall (20A) of the cover (20) along the third axis (Z) while allowing movement of the locking member (541) in along the second axis (Y).

4. The outer operational device as claimed in claim 1, further comprising: a guiding rod (565) having an engagement end (566) and a positioning end (567), with the leg (531) of the sliding block (511) further including a positioning hole (539), with the engagement end (566) of the guiding rod (565) engaged with the wing (563) of the limiting plate (559), with the positioning end (567) of the guiding rod (565) engaged in the positioning hole (539) of the leg (531), with the other spring (571) mounted around the guiding rod (565), with the guiding rod (565) movable together with the sliding block (511) between the upper and lower positions, with the guiding rod (565) preventing distortion of the other spring (571).

5. The outer operational device as claimed in claim 1, with the connection member (595) further including an upper sliding groove (609) extending from the first surface (603) through the second surface (605), with the first guide pin (346) of the cover (20) extending through the opening (583) of the push member (575) into the upper sliding groove (609), with the connection member (595) further including a lower sliding groove (611) extending from the first surface (603) through the second surface (605) and located below the upper sliding groove (609), with the second guide pin (347) received in the lower sliding groove (611), with the first and second guide pins (346, 347) preventing the connection member (595) from rotating about the third axis (Z) and preventing the connection member (595) from moving along the second axis (Y).

6. The outer operational device as claimed in claim 1, with the pressing rod (442) including a driving end (445) and an engagement end (443), with an insertion block (446) formed on the engagement end (443) and having a plurality of teeth (447) spaced from each other along the first axis (X), with the driving member (44) further including a base portion (440) having an engaging portion (448) mounted to the connection member (595), with the base portion (440) further including an intermediate portion (441) having an engagement groove (449), with the engagement groove (449) including two lateral walls (449A), with a plurality of teeth (450) formed on each of the lateral walls (449A) and spaced from each other along the first axis (X), with the pressing rod (442) detachably engaged with the base portion (440), with the insertion block (446) received in the engagement groove (449) of the base portion (440), with the plurality of teeth (447) of the pressing rod (442) engaged with the plurality of teeth (450) of the base portion (440), with the pressing rod (442) and the base portion (440) jointly movable along the first axis (X).

* * * * *